US006995724B2

(12) United States Patent
Teshirogi et al.

(10) Patent No.: US 6,995,724 B2
(45) Date of Patent: Feb. 7, 2006

(54) WAVEGUIDE SLOT TYPE RADIATOR HAVING CONSTRUCTION TO FACILITATE MANUFACTURE

(75) Inventors: Tasuku Teshirogi, Tokyo (JP); Yuki Kawahara, Hadano (JP)

(73) Assignee: Anritsu Corporation, Tokyo (JP)

( * ) Notice: Subject to any disclaimer, the term of this patent is extended or adjusted under 35 U.S.C. 154(b) by 125 days.

(21) Appl. No.: 10/471,942

(22) PCT Filed: Nov. 19, 2002

(86) PCT No.: PCT/JP02/12066

§ 371 (c)(1),
(2), (4) Date: Sep. 15, 2003

(87) PCT Pub. No.: WO03/044896

PCT Pub. Date: May 30, 2003

(65) Prior Publication Data

US 2004/0090290 A1 May 13, 2004

(30) Foreign Application Priority Data

Nov. 20, 2001 (JP) ..... 2001-354608

(51) Int. Cl.
*H01Q 13/10* (2006.01)

(52) U.S. Cl. ..... 343/771; 343/770; 333/237

(58) Field of Classification Search ..... 343/767, 343/768, 770, 771; 333/237

See application file for complete search history.

(56) References Cited

U.S. PATENT DOCUMENTS

| | | | | |
|---|---|---|---|---|
| 4,129,872 A | * | 12/1978 | Toman | 343/768 |
| 4,658,261 A | * | 4/1987 | Reid et al. | 343/771 |
| 4,872,020 A | * | 10/1989 | Ajioka | 343/771 |
| 5,010,351 A | * | 4/1991 | Kelly | 343/771 |
| 5,638,079 A | * | 6/1997 | Kastner et al. | 343/770 |
| 5,977,925 A | | 11/1999 | Hamnén et al. | |

FOREIGN PATENT DOCUMENTS

| | | | |
|---|---|---|---|
| EP | 0 708 490 A1 | A | 4/1996 |
| GB | 758457 | A | 10/1956 |
| JP | 59 139707 | A | 10/1984 |
| JP | 60-163810 | U | 10/1985 |
| JP | 2-302106 | A | 12/1990 |
| JP | 4-247702 | A | 9/1992 |
| JP | 11-214919 | A | 8/1999 |

OTHER PUBLICATIONS

K. Sakakibara et al; "Millimeter–Wave Slotted Waveguide Array Antenna Manufactured by Metal Injection Molding for Automotive Radar Systems"; IEICE Trans. Commun. vol. E84–B, No. 9, Sep. 2001; pp. 2369–2376.

* cited by examiner

*Primary Examiner*—Tho Phan
(74) *Attorney, Agent, or Firm*—Frishauf, Holtz, Goodman & Chick, P.C.

(57) ABSTRACT

A waveguide portion has a waveguide with a rectangular section surrounded by a pair of narrow side plates opposed to each other, a pair of broad side plates extending along lengthwise directions of the pair of narrow side plates. A radiation portion is provided on one broad side plate of the pair of broad side plates of the waveguide portion, and has a plurality of slots for radiating an electromagnetic wave input into the waveguide portion externally from the one broad side plate. The waveguide portion includes a first waveguide member and a second waveguide member, and is constituted by joining the first waveguide member and the second waveguide member at edge portions extending in longitudinal directions thereof matching with central lines of the pair of broad side plates. The plurality of slots of the radiation portion has a first group of slots and a second group of slots defined respectively in the first waveguide portion and the second waveguide portion at predetermined intervals in a staggered manner. The first group of slots and the second group of slots are provided such that one set of sides of the respective slots are coincident with the central lines of the pair of broad side plates.

20 Claims, 16 Drawing Sheets

WAVEGUIDE SLOT TYPE RADIATOR HAVING CONSTRUCTION TO FACILITATE MANUFACTURE

This application is a U.S. National Phase Application under 35 USC 371 of International Application PCT/JP02/12066 filed Nov. 19, 2002.

TECHNICAL FIELD

The present invention relates to a slotted waveguide radiator, and in particular to a slotted waveguide radiator employing a technique for facilitating manufacture of the radiator.

BACKGROUND ART

In general, as a radiator used in an antenna or a feed portion therefor in a communication field for a millimeter wave band or a quasi-millimeter wave band, a slotted waveguide radiator is used as a radiator which can radiate electromagnetic waves efficiently.

As shown in FIG. 16, the slotted waveguide radiator is constituted such that slender slot 2 is provided so as to be coincident with a flow direction of magnetic flux F generated at a broad side plate 1*a* by electromagnetic wave P propagating inside a waveguide 1 with a rectangular section thereby radiating the electromagnetic wave externally.

Incidentally, the intensity of the electromagnetic wave radiated from the slot 2 externally depends on the magnitude of the magnetic flux F at a position where the slot 2 is provided.

The magnitude of the magnetic flux F becomes larger as it is farther away from the central line C of the broad side plate 1*a*.

Further, the magnetic flux F is generated so as to turn inversely at intervals of ½ of waveguide wavelength λg.

Accordingly, for example, in case that electromagnetic waves with the same intensity and the same phase are radiated from a plurality of slots provided in a waveguide, it is necessary to consider attenuation and phase of the electromagnetic waves propagating inside the waveguide due to radiation form respective slots.

For this reason, as shown in FIG. 17, a plurality of slots $\mathbf{2}_1, \mathbf{2}_2, \ldots \mathbf{2}_n$ are provided about the central line of the broad side plate 1*a* in a staggered manner at intervals of ½ of a waveguide wavelength λg and setting is made such that distances $r_1, r_2, \ldots r_n$ from the central line C of the broad side plate 1*a* become larger as the slots become farther from an input end of the electromagnetic wave P.

As the slotted waveguide radiator which radiates electromagnetic wave on the basis of such a principle, there are one having a single waveguide array structure where the plurality of slots $\mathbf{2}_1, \mathbf{2}_2, \ldots \mathbf{2}_n$ are provided along the lengthwise direction of the waveguide 1 at predetermined intervals, as described above, so that a radiation face serving as a radiator are widened in the lengthwise direction of the waveguide 1, one having a single waveguide single slot structure where only one slot is provided, or one having a planar structure where the radiators having the above-described array structure are provided in parallel so that a radiation face serving as a radiator is expanded in its lengthwise direction and in a widthwise direction.

The slotted waveguide radiator having the above-described single waveguide array structure can be used, for example, as a feed portion for feeding electromagnetic wave with the same phase to one side of a dielectric base board of a planar antenna such as a dielectric leaky-wave antenna or the like.

Further, the slotted waveguide radiator with the above-described planar structure can be used as a planar antenna for a quasi-millimeter wave band or a millimeter wave band as it is.

As a method for manufacturing such a slotted waveguide radiator, a method for performing integral molding by an injection molding is conventionally employed regarding the above-described single waveguide array structure.

Furthermore, in the slotted waveguide radiator with the planar structure, as shown in FIG. 18, a method for forming a plurality of waveguide paths in parallel by providing a plurality of narrow side plates 12 in parallel in a standing manner on a bottom wall 11 having a width corresponding to a plurality of single waveguides and fixing an upper plate 14 which has the same width as that of the bottom plate 11 and is formed with slots 13 in advance is adopted.

In the method utilizing the injection molding, however, since a direction in which a mold for forming a waveguide portion is drawn out and a direction in which a mold for forming a slot portion is drawn out are perpendicular to each other, there is a problem that the molds must be complicated and they can not be manufactured at an inexpensive cost.

Further, as described above, in case of the slotted waveguide radiator used as the feed portion for the dielectric leaky-wave antenna or the like, a H matching plate may be provided in front of a slot for matching with the dielectric base board.

In this case, there occurs a problem that the mold for forming a slot portion can not be released due to interference with the matching plate so that the matching plate must be formed as a separate member.

On the other hand, as described above, in the method for constituting a planar type slotted waveguide radiator by providing a plurality of narrow side plates 12 on the bottom plate 11 in a standing manner and fixing the upper plate 14 above them, since the performance of the radiator deteriorates due to leakage of electromagnetic waves even if there are slight gaps between upper and lower edges of the plurality of narrow side plates 12, and the lower plate 11 and the upper plate 14, there occurs a problem that much labor and time are required for connecting work for these members.

On the other hand, as a prior art which can solve the problems as described above, IEICE Trans. COMMUN., VOL. E84-B, NO. 9 SEPTEMBER 2001, pp 2369–2376, "Millimeter-Wave Slotted Waveguide Array Antenna Manufactured by Metal Injection Molding for Automotive Radar Systems" by Kunio SAKAKIBARA, Toshiaki WATANABE, Kazuo SATO, Kunitoshi NISHIKAWA, and Kazuyuki SEO is known.

That is, the millimeter wave slotted waveguide array antenna according to the prior art is constituted with waveguide slots where 45° slanting slots are provided on narrow faces of waveguides stacked in a two stage manner through broad faces at intervals of λg/2 in a staggered manner regarding the upper and lower waveguides, and a feed portion for performing feeding of the two waveguides with opposite phases.

In the prior art, however, there is a problem that the feed portion for performing opposite phase feeding is complicated and distances between the slots become large in the slanting direction, large grating lobe occurs in this direction, and it is difficult to secure a size accuracy required for millimeter wave in a molding.

DISCLOSURE OF INVENTION

An object of the present invention is to solve the problems as described above and provide a slotted waveguide radiator which can be manufactured with a simple mould at an inexpensive cost and can facilitate joining work therefor, and further prevents grating lobe from occurring.

Further, another object of the present invention is to solve the problems as described above and provide a slotted waveguide radiator which can be manufactured with a simple mould at an inexpensive cost and can facilitate joining work therefor, and where a matching plate can be provided integrally.

In order to achieve the above object, according to a first aspect of the present invention, there is provided a slotted waveguide radiator comprising:

a waveguide portion having a waveguide with a rectangular section surrounded by a pair of narrow side plates opposed to each other, and a pair of broad side plates extending along the lengthwise direction of the pair of narrow side plates; and a radiation portion which is provided on one broad side plate of the pair of broad side plates of the waveguide portion and which has a plurality of slots for radiating an electromagnetic wave input into the waveguide portion externally from the one broad side plate, wherein the waveguide portion includes a first waveguide member and a second waveguide member, and the first waveguide member and the second waveguide member are joined at edge portions, in longitudinal directions thereof, matched with central lines of the pair of broad side plates;

the plurality of slots of the radiation portion have a first group of slots and a second group of slots which are respectively defined in the first waveguide member and the second waveguide member at predetermined intervals in a staggered manner; and the first group of slots and the second group of slots are provided such that one side of each slot of the respective groups is coincident with the central lines of the pair of broad side plates.

In order to achieve the above object, according to a second aspect of the present invention, there is provided a slotted waveguide radiator according to the first aspect, wherein the predetermined interval is set to an interval of ½ of a waveguide wavelength $\lambda g$ of an electromagnetic wave to be radiated by the slotted waveguide radiator in the waveguide portion.

In order to achieve the above object, according to a third aspect of the present invention, there is provided a slotted waveguide radiator according to the first aspect, wherein the first group of slots and the second group of slots are set such that the widths of the respective slots are made larger from a position near to an input end of an electromagnetic wave to be radiated by the slotted waveguide radiator toward a position farther therefrom.

In order to achieve the above object, according to a fourth aspect of the present invention, there is provided a slotted waveguide radiator according to the third aspect, wherein the input end of the electromagnetic wave is of an edge feed type formed at one end, in a longitudinal direction, of the waveguide portion.

In order to achieve the above object, according to a fifth aspect of the present invention, there is provided a slotted waveguide radiator according to the third aspect, wherein the input end of the electromagnetic wave is of a center feed type formed at a center, in a longitudinal direction, of the waveguide portion.

In order to achieve the above object, according to a sixth aspect of the present invention, there is provided a slotted waveguide radiator according to the third aspect, wherein a plurality of reflection suppressors are provided on an inner wall of the waveguide portion at predetermined intervals in a longitudinal direction of the waveguide portion.

In order to achieve the above object, according to a seventh aspect of the present invention, there is provided a slotted waveguide radiator according to the sixth aspect, wherein the plurality of reflection suppressors are ribs.

In order to achieve the above object, according to an eighth aspect of the present invention, there is provided a slotted waveguide radiator according to the sixth aspect, wherein the plurality of reflection suppressors are grooves.

In order to achieve the above object, according to a ninth aspect of the present invention, there is provided a slotted waveguide radiator according to the third aspect, wherein at least one end where the input end of the electromagnetic wave in the longitudinal direction of the waveguide portion is not formed is terminated at a terminating plate.

In order to achieve the above object, according to a tenth aspect of the present invention, there is provided a slotted waveguide radiator according to the first aspect, wherein a matching portion forming member for feeding an electromagnetic wave radiated from the slotted waveguide radiator to a dielectric leaky-wave antenna efficiently is provided integrally with the waveguide portion.

In order to achieve the above object, according to an eleventh aspect of the present invention, there is provided a slotted waveguide radiator according to the first aspect, wherein the waveguide portion includes a plurality of waveguide members, and the plurality of waveguide members include two channel-shaped members formed integrally in a sectional channel shape by a strip-shaped base plate forming the narrow side plate, a first half width plate extending from one edge portion of the base plate along in a lengthwise direction thereof in a direction perpendicular to the base plate by a distance equal to ½ of the broad side plate, and a second half width plate extending from the other edge portion of the base plate along the lengthwise direction thereof in a direction opposed to the first half width plate in parallel thereto by a distance equal to ½ of the broad side plate.

In order to achieve the above object, according to a twelfth aspect of the present invention, there is provided a slotted waveguide radiator according to the eleventh aspect, wherein the two channel-shaped members are integrated in a state that joining of end faces of the first half width plates of the two channel-shaped members and joining of end faces of the second half width plates thereof have been conducted.

In order to achieve the above object, according to a thirteenth aspect of the present invention, there is provided a slotted waveguide radiator according to the eleventh aspect, wherein the plurality of waveguide members include an H-shaped member formed integrally in a sectional H shape by a strip-shaped base plate forming the narrow side plate, a first half width plate extending from one edge portion of the base plate along in a lengthwise direction thereof in a direction perpendicular to the base plate by a distance equal to ½ of the broad side plate, a second half width plate extending from the other edge portion of the base plate along the lengthwise direction thereof in a direction opposed to the first half width plate in parallel thereto by a distance equal to ½ of the broad side plate, a third half width plate extending from one edge portion of the base plate along the longitudinal direction thereof in a direction perpendicular to the base plate and opposed to the first half width plate by a distance equal to ½ of the broad side plate, and a fourth half width plate extending from the other edge portion of the base plate along the longitudinal direction thereof in a direction opposed to the third half width plate in parallel thereto by a distance equal to ½ of the broad side plate.

In order to achieve the above object, according to a fourteenth aspect of the present invention, there is provided a slotted waveguide radiator according to the thirteenth aspect, wherein the waveguide portion comprises the H-shaped member and the two channel-shaped members which are integrated in a state that joining of end faces of the H-shaped member and the first half width plate of one of the two channel-shaped members to each other and joining of end faces of the second half width plates to each other have been conducted, and joining of end faces of the third half width plate of the H-shaped member and the first half width plate of the other of the two channel-shaped members to each other and joining of end faces of the fourth half width plate of the H-shaped member and the second half width plate of the other of the two channel-shaped members to each other have been conducted.

In order to achieve the above object, according to a fifteenth aspect of the present invention, there is provided a slotted waveguide radiator according to the thirteenth aspect, wherein a third group of slots and a fourth group of slot are provided in the respective end faces of the H-shaped member in a staggered manner to the first group of slots and the second group of slots.

In order to achieve the above object, according to a sixteenth aspect of the present invention, there is provided a slotted waveguide radiator according to the thirteenth aspect, wherein the waveguide portion has the plurality of H-shaped members mounted between the two channel-shaped members, and is configured in an integral manner by providing the respective H-shaped members adjacent to one another such that joining of end faces of the first half width plate and the third half width plate to each other and joining of the second half width plate and the fourth half width plate to each other have been conducted, joining of end faces of the H-shaped member on one end of the waveguide portion and the first half width plate of one of the two channel-shaped members and joining of end places of the H-shaped member on the one end and the second half width plate have been conducted, and joining of end faces of the third half width plate of the H-shaped member on the other end of the waveguide portion and the first half width plate of the other of the two channel-shaped members and joining of end faces of the fourth half width plate of the H-shaped member on the other end thereof and the second half width plate of the other of the two channel-shaped members have been conducted.

In order to achieve the above object, according to a seventeenth aspect of the present invention, there is provided a slotted waveguide radiator according to the sixteenth aspect, wherein two groups of slots are respectively provided in the respective end faces of the plurality of H-shaped members in a staggered manner to the first group of slots and the second group of slots.

In order to achieve the above object, according to an eighteenth aspect of the present invention, there is provided a slotted waveguide radiator according to the eleventh aspect, wherein a matching portion forming member for feeding an electromagnetic wave radiated from the slotted waveguide radiator to a dielectric leaky-wave antenna efficiently is integrally provided on the waveguide portion.

In order to achieve the above object, according to a nineteenth aspect of the present invention, there is provided a slotted waveguide radiator according to the eleventh aspect, wherein the two channel-shaped members are each formed by injection molding using molds in a sectional channel shape where the pair of broad side plates including the one broad side plate where the first group of slots and the second group of slots are defined and the pair of narrow side plates have been divided into two pieces at central lines of the pair of broad side plates.

In order to achieve the above object, according to a twentieth aspect of the present invention, there is provided a slotted waveguide radiator according to the thirteenth aspect, wherein the H-shaped member is formed integrally by injection molding using molds in a sectional H shape by a strip-shaped base plate forming the narrow side plate, a first half width plate extending from one edge portion of the base plate along in a lengthwise direction thereof in a direction perpendicular to the base plate by a distance equal to ½ of the broad side plate, a second half width plate extending from the other edge portion of the base plate along the lengthwise direction thereof in a direction opposed to the first half width plate in parallel thereto by a distance equal to ½ of the broad side plate, a third half width plate extending from the edge portion of the base plate along the longitudinal direction thereof in a direction perpendicular to the base plate and opposed to the first half width plate by a distance equal to ½ of the broad side plate, and a fourth half width plate extending from the other edge portion of the base plate along the longitudinal direction thereof in a direction opposed to the third half width plate in parallel thereto by a distance equal to ½ of the broad side plate.

BEST MODE FOR CARRYING OUT THE INVENTION

Each embodiment of the present invention will be explained below with reference to the drawings.

(First Embodiment)

Figure 1:
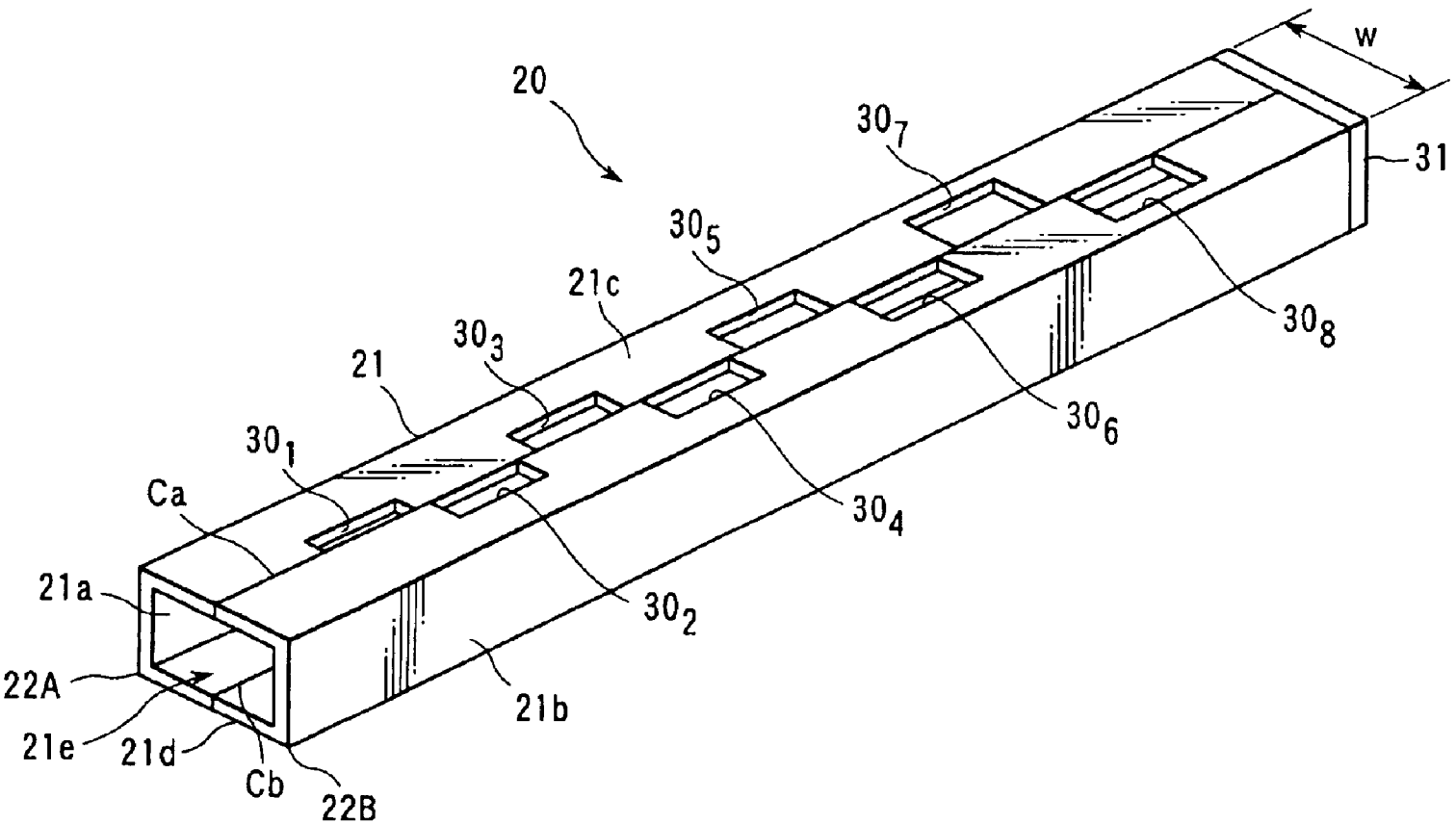
FIG. 1 is a perspective view showing an appearance constitution of a slotted waveguide radiator with a single waveguide array structure as a first embodiment according to the present invention.

FIG. 1 is a perspective view showing an appearance constitution of a slotted waveguide radiator with a single waveguide array structure as a first embodiment according to the present invention.

Figure 2:
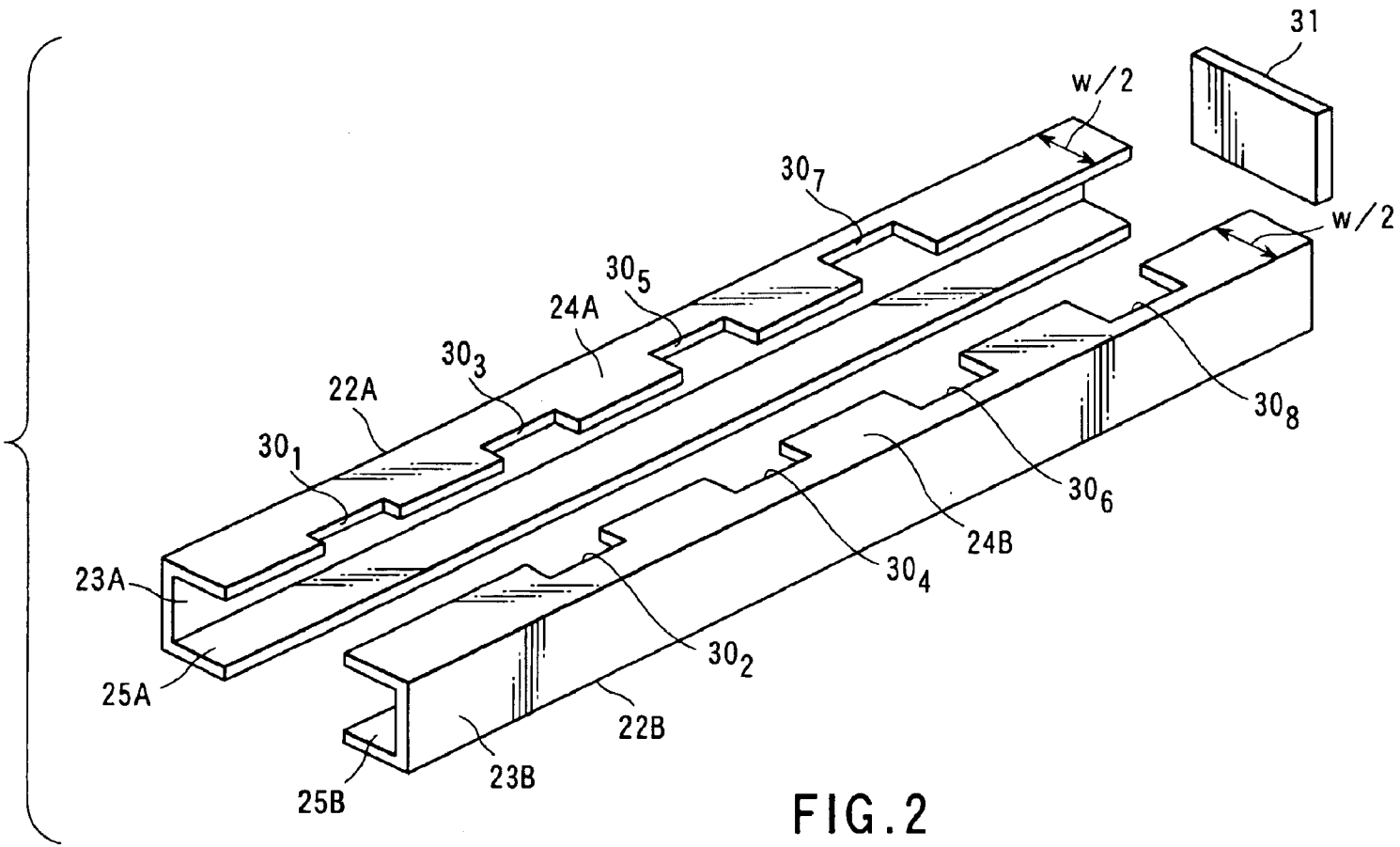
FIG. 2 is an exploded perspective view showing an exploded structure of the slotted waveguide radiator in FIG. 1.

FIG. 2 is an exploded perspective view showing an exploded structure of the slotted waveguide radiator in FIG. 1.

Figure 3:
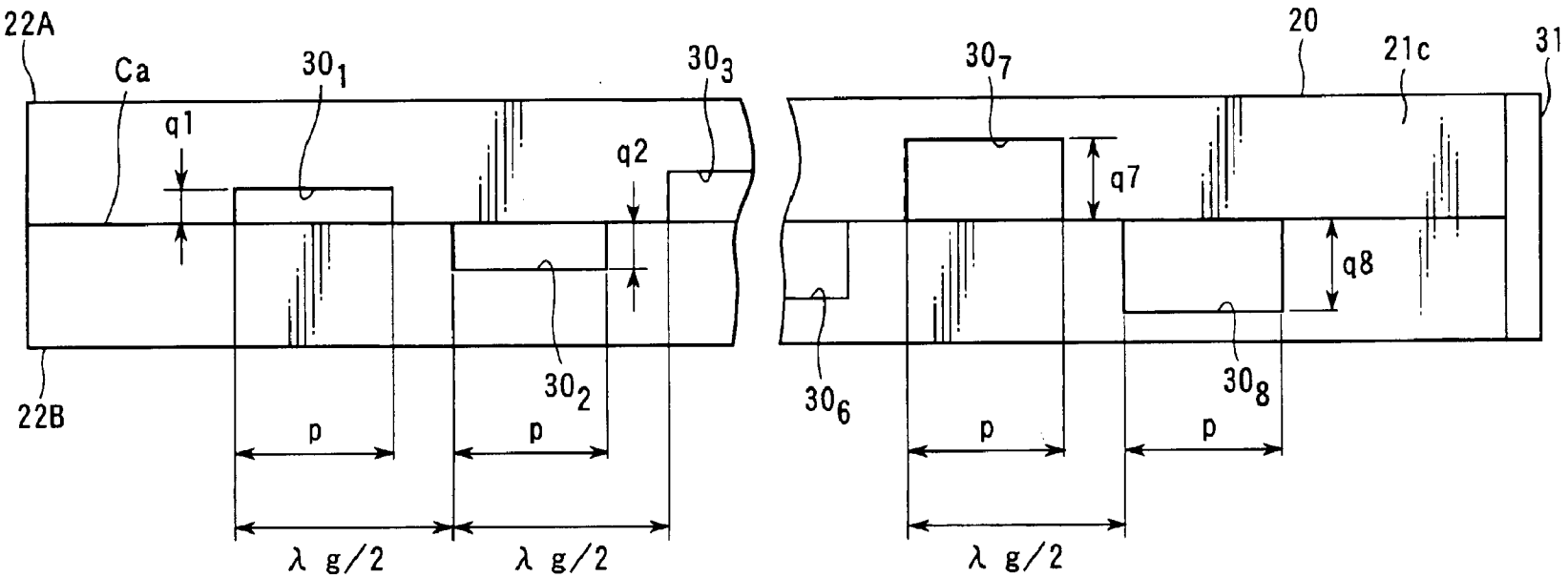
FIG. 3 is a plan view of the slotted waveguide radiator in FIG. 1.

FIG. 3 is a plan view of the slotted waveguide radiator in FIG. 1.

That is, as shown in FIG. 1 to FIG. 3, a slotted waveguide radiator 20 according to a first embodiment of the present invention has the above-described single waveguide array structure.

A waveguide portion 21 of the slotted waveguide radiator 20 is provided, as first and second waveguide members, with a waveguide 21*e* with a rectangular (oblong) section surrounded by a pair of narrow side plates 21*a*, 21*b* opposed to each other in parallel with each other and a pair of broad side plates 21*c*, 21*d* opposed to each other in parallel to each other so as to join edge portions of the narrow side plates 21*a*, 21*b* extending along their longitudinal directions.

The waveguide portion 21 is constituted with two channel-shaped members 22A, 22B joined at central lines Ca, Cb of the pair of broad side plates 21*c*, 21*d*.

As shown in FIG. 2, one channel-shaped member 22A is constituted integrally with a strip-shaped base plate 23A forming one narrow side plate 21*a*, a first half width plate 24A extending from one edge portion (an upper edge) along the lengthwise direction of the base plate 23A by a distance equal to ½ of the width w of the broad side plates 21*c*, 21*d* in a direction perpendicular to the base plate 23A, and a second half width plate 25A extending from the other edge portion (a lower edge) along the lengthwise direction of the base plate 23A by a distance equal to ½ of the width w of the broad side plate 21*c*, 21*d* in a direction opposite to the first half width plate 24A in parallel therewith as a plurality of waveguide members.

Further, the other channel-shaped member 22B is constituted integrally with a strip-shaped base plate 23B forming the other narrow side plate 21*b*, a first half width plate 24B extending from one edge portion (an upper edge) along the lengthwise direction of the base plate 23B by a distance equal to ½ of the width w of the broad side plates 21*c*, 21*d* in a direction perpendicular to the base plate 23B, and a second half width plate 25B extending from the other edge portion (a lower edge) along the lengthwise direction of the base plate 23B by a distance equal to ½ of the width w of the broad side plate 21*c*, 21*d* in a direction opposite to the first half width plate 24B in parallel therewith as a plurality of waveguide members.

Two channel-shaped members 22A, 22B thus constituted are integrated so as not to separate from each other by unillustrated joining means (welding, screwing or the like) in a state that edges of the first half width plates 24A, 24B, and edges of the second half width plates 25A, 25B have been brought in contact with each other.

In such a joined state, the first half width plates 24A, 24B form the broad side plate 21*c* of the waveguide portion 21.

Further, the second half width plates 25A, 25B form the broad side plate 21*d* of the waveguide portion 21.

In the broad side plate 21*c* formed by the first half width plates 24A, 24B, a plurality of n (n=8 in this example) rectangular slots $\mathbf{30}_1$, $\mathbf{30}_2$, . . . $\mathbf{30}_8$ whose one sides are coincident with the central line Ca (namely, a joined line of the first half width plates 24A, 24B), for example, are provided at intervals of ½ of the waveguide wavelength λg in the waveguide portion 21 for electromagnetic wave to be radiated from the slotted waveguide radiator 2 about the central line Ca in a staggered manner.

With such a constitution, since electromagnetic waves radiated from respective slots $\mathbf{30}_1$, $\mathbf{30}_2$, . . . $\mathbf{30}_8$ are excited with the same phase and the intervals between the respective slots $\mathbf{30}_1$, $\mathbf{30}_2$, . . . $\mathbf{30}_8$ are ½ of the waveguide wavelength λg, occurrence of grating lobe can be suppressed.

Of the respective slots $\mathbf{30}_1$, $\mathbf{30}_2$, . . . $\mathbf{30}_8$, the odd-numbered slots $\mathbf{30}_1$, $\mathbf{30}_3$, $\mathbf{30}_5$, $\mathbf{30}_7$ counted from one end side of the waveguide portion 21 are formed by cutting-off, for example, in a rectangular shape from the edge portion of the joined portion side of the first half width plate 24A of one channel-shaped member 22A toward the opposite edge portion.

Further, of the respective slots $\mathbf{30}_1$, $\mathbf{30}_2$, . . . $\mathbf{30}_8$, even-numbers slots $\mathbf{30}_2$, $\mathbf{30}_4$, $\mathbf{30}_6$, $\mathbf{30}_8$ counted from the one end side of the waveguide portion 21 are formed by cutting-off, for example, in a rectangular shape from the edge portion of the joined portion side of the first half width plate 24B of the other channel-shaped member 22B toward the opposite edge portion.

Incidentally, the shape of the slots $\mathbf{30}_1$, $\mathbf{30}_2$, . . . $\mathbf{30}_8$ is not limited to a rectangle, but it may be formed in a long hole shape where both ends of a rectangle have been rounded, a semi-circular shape, or a semi-oval shape. Briefly speaking, it is important that one side of the slot is coincident with the central line Ca.

As shown in FIG. 3, the lengths P of the respective slots $\mathbf{30}_1$, $\mathbf{30}_2$, . . . $\mathbf{30}_8$ along the lengthwise direction of the waveguide portion 21 are identical.

Further, the widths $q_1$, $q_2$, . . . $q_8$ (depths from the joined side edge portion) of the respective slots $\mathbf{30}_1$, $\mathbf{30}_2$, . . . $\mathbf{30}_8$ in a direction perpendicular to the lengthwise direction of the waveguide portion 21 are made considerably larger than the width of the slot 2 formed in the above-described slotted waveguide radiator.

As described above, the intensities of electromagnetic waves radiated from the respective slots of the slotted waveguide radiator are determined depending on the magnitude of a magnetic current flowing in the lengthwise direction of the slots, and the magnitude of the magnetic current is determined according to the distance of the broad side plate of the waveguide from the central line.

Then, the following relationship is established between the distance $X_n$ and a conductance $g_n$ determining radiation power of electromagnetic wave.

$$gn=K\cdot\sin^2(\pi Xn/a)$$

Incidentally, a is a width of a broad face of the waveguide and K is a constant.

Here, as described above, in case that the respective slots 30$_1$, 30$_2$, . . . 30$_8$ extend to the central line Ca of the broad side plate 21*c*, since the magnitude of the electromagnetic current at a position near the central line Ca is very small, the electromagnetic current does not contribute to radiation from the above equation.

Further, in this case, the intensities of electromagnetic waves radiated from the slots 30$_1$, 30$_2$, . . . 30$_8$ depend on the positions of the edges of the respective slots 30$_1$, 30$_2$, . . . 30$_8$ from the central line Ca of the broad side plate 21*c*, namely, the widths $q_1$, $q_2$, . . . $q_8$ of the respective slots 30$_1$, 30$_2$, . . . 30$_8$.

Therefore, considering the attenuation of the electromagnetic wave propagating inside the waveguide portion 21 due to the radiations from the respective slots 30$_1$, 30$_2$, . . . 30$_8$, the intensities of the electromagnetic waves radiated from the respective slots 30$_1$, 30$_2$, . . . 30$_8$ can be made constant by setting the widths $q_1$, $q_2$, . . . $q_8$ of the respective slots 30$_1$, 30$_2$, . . . 30$_8$ to increase in the order from a near side to the input end of one end side (the left end side) of the waveguide portion 21 toward a farther side therefrom.

Incidentally, the other end side of the waveguide portion 21 is terminated at an end plate 31.

Further, in case that power of electromagnetic wave reaching the terminating portion is small and adverse influence due to reflection is reduced, the other end side of the waveguide portion 21 may be closed a metal plate.

Thus, in the slotted waveguide radiator 20 with the above-described constitution, the waveguide portion 21 is constituted with two channel-shaped members 22A, 22B which are joined at the central lines Ca, Cb of the broad side plates 21*c*, 21*d* opposed to each other, and one sides of the slots 30$_1$, 30$_2$, . . . 30$_n$ are provided so as to be coincident with the central line Ca of one broad side plate 21*c*.

Figure 4A:
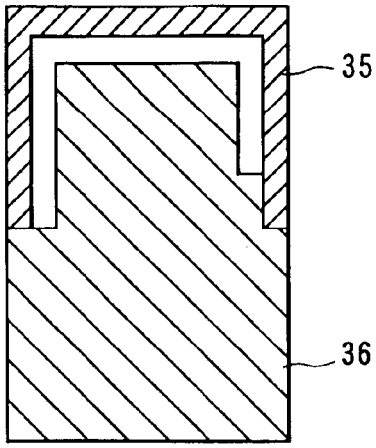
FIGS. 4A and 4B are sectional views for explaining a manufacturing method of a main portion of the slotted waveguide radiator in FIG. 1.

For this reason, for example, as shown in FIG. 4A, two channels-shaped members 22A (22B) are molded by the so-called injection molding using a recessed mold 35 and a projecting mold 36.

Figure 4B:
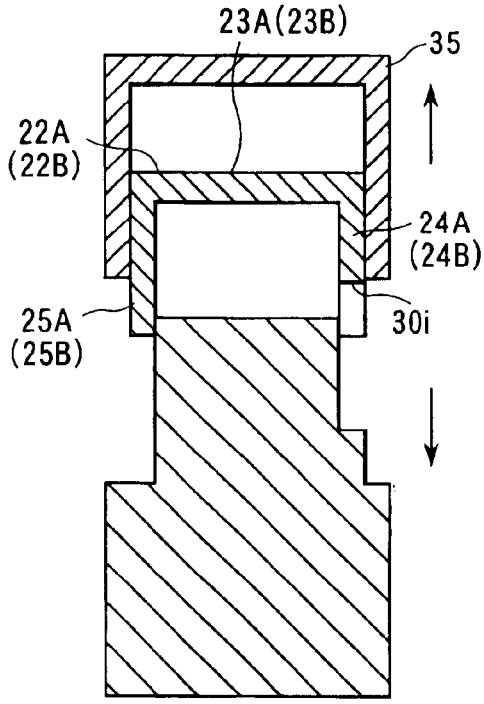

After molding, as shown in FIG. 4B, two channel-shaped members 22A (22B) with portions corresponding to the slots 30$_i$ can be manufactured simultaneously by drawing out these molds 35, 36 in upward and downward directions shown with arrows, respectively.

Accordingly, by using the molds 35, 36 to mold two channel-shaped members 22A (22B) by the so-called injection molding, the whole slotted waveguide radiator 20 can be manufactured inexpensively and easily, and mass production is allowed.

Further, since electromagnetic wave radiated in the vicinity of the central line Ca of the broad side plates 21*c*, 21*d* is fine, as described above, even if there is a slight gap at joined portion of two channel-shaped members 22A, 22B, the performance of the entire slotted waveguide radiator 20 is prevented from deteriorating.

Accordingly, the joining work of two channel-shaped members 22A, 22B can be accomplished by a simple joining work which has not so much restriction.

Incidentally, as described above, in case that the widths $q_1$, $q_2$, . . . $q_8$ of the respective slots 30$_1$, 30$_2$, . . . 30$_8$ are different, impedances of the respective slots 30$_1$, 30$_2$, . . . 30$_8$ varies due to that the phases of the electromagnetic waves radiated from the respective slots 30$_1$, 30$_2$, . . . 30$_8$ vary and a reflection wave may occur inside the waveguide portion 21 in some cases.

Figure 6:
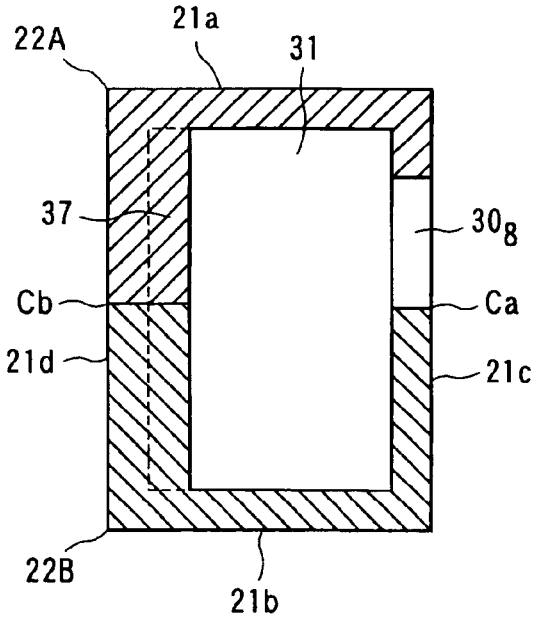
FIG. 6 is an enlarged sectional view showing a section taken along line 6-6 in FIG. 5 in an enlarged manner.
Figure 5:
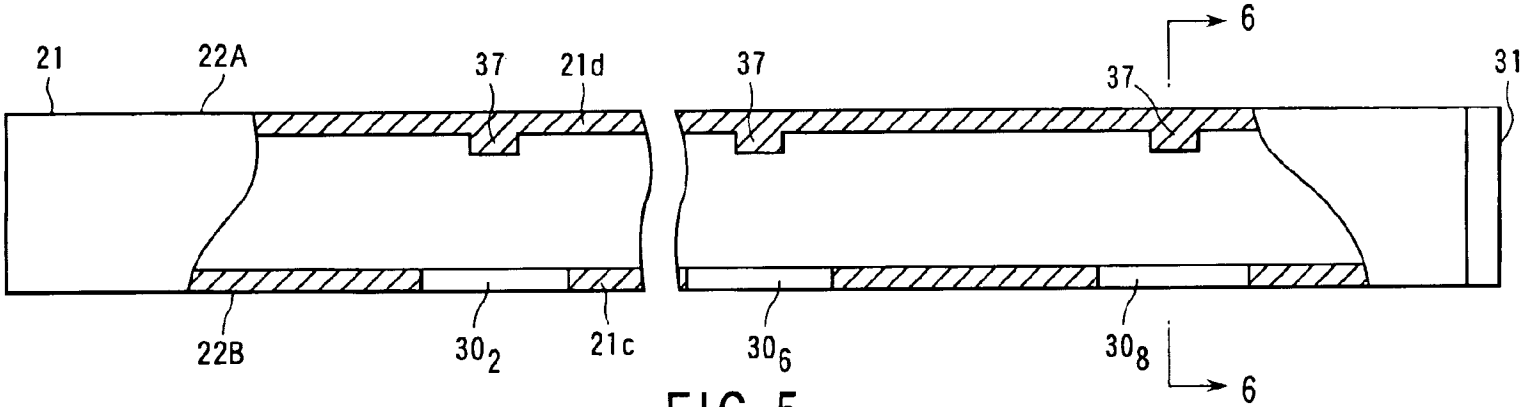
FIG. 5 is a plan view showing a case that ribs are provided on the slotted waveguide radiator in FIG. 1 as a reflection suppressor in a partially cut-off manner.

In case that this reflection wave can not be neglected, as shown in FIG. 5 and FIG. 6, ribs 37 with a predetermined height serving as a reflection suppressor and extending in a direction perpendicular to the lengthwise direction of the waveguide portion 21 are provided in a projecting manner on an inner wall of the broad side plate 21*d* opposed to the broad side plate 21*c* provided with the slots 30$_1$, 30$_2$, . . . 30$_8$, so that a reflection wave returned back to the input end side can be suppressed.

Incidentally, besides the case that the ribs 37 serving as the reflection suppressors are provided one for each slot, as shown in FIG. 5, they may be provided one for each adjacent slots 30$_i$, 30$_{i+1}$.

Figure 7:
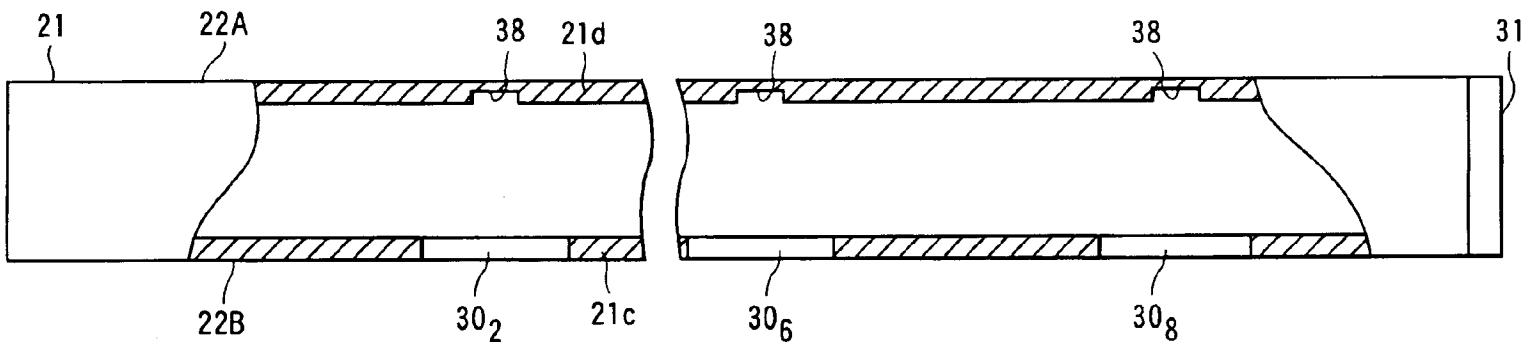
FIG. 7 is a plan view showing a case that grooves are provided on the slotted waveguide radiator in FIG. 1 as a reflection suppressor in a partially cut-off manner.

Further, as shown in FIG. 7, grooves 38 with a predetermined depth extending in a direction perpendicular to the lengthwise direction of the waveguide portion 21 may be provided as the reflection suppressor instead of the ribs 38.

Moreover, it is possible to provide these reflection suppressors (37, 38) on the inner wall of the base plates 23A, 23B.

Incidentally, even in the case that the reflection suppressors comprising the ribs 37 or the grooves 38 have been provided in the above manner, molding can easily be performed like the above according to the injection molding by providing grooves for forming the rib 37 or ribs for forming the groove 38 in the above-described projecting mold 36.

The above-described slotted waveguide radiator 20 has the single waveguide array structure, but the present invention can be applied to a case of a slotted waveguide radiator where a single slot is provided like the above.

That is, in this case, the fact that the waveguide portion 21 is constituted with two channel-shaped members 22A, 22B joined at the central line of the broad side plates 21*c*, 21*d* is similar to the above.

In this case, also, by providing one side of one rectangular slot 30 so as to coincide with the central line Ca of the broad side plate 21*c*, two channel-shaped members 22A, 22B can be manufactured by a simpler mold and the joining work can be performed by a simpler joining work.

Further, the above-described slotted waveguide radiators 20, 20' employ an edge feed type where electromagnetic wave is input from one end of the waveguide portion 21.

Figure 8:
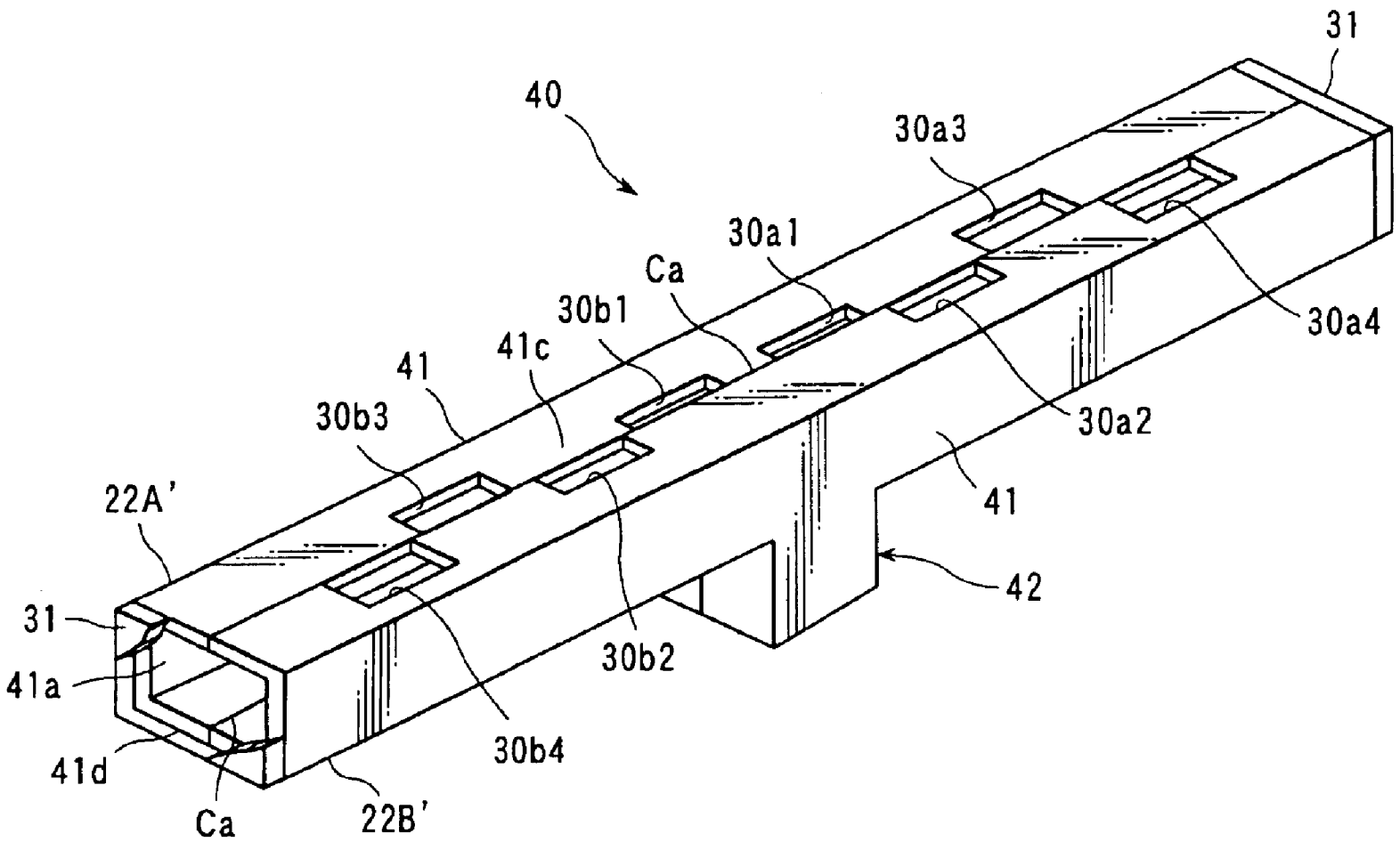
FIG. 8 is a perspective view showing a modification example constituted as a center feed type in the slotted waveguide radiator in FIG. 1.
Figure 9:
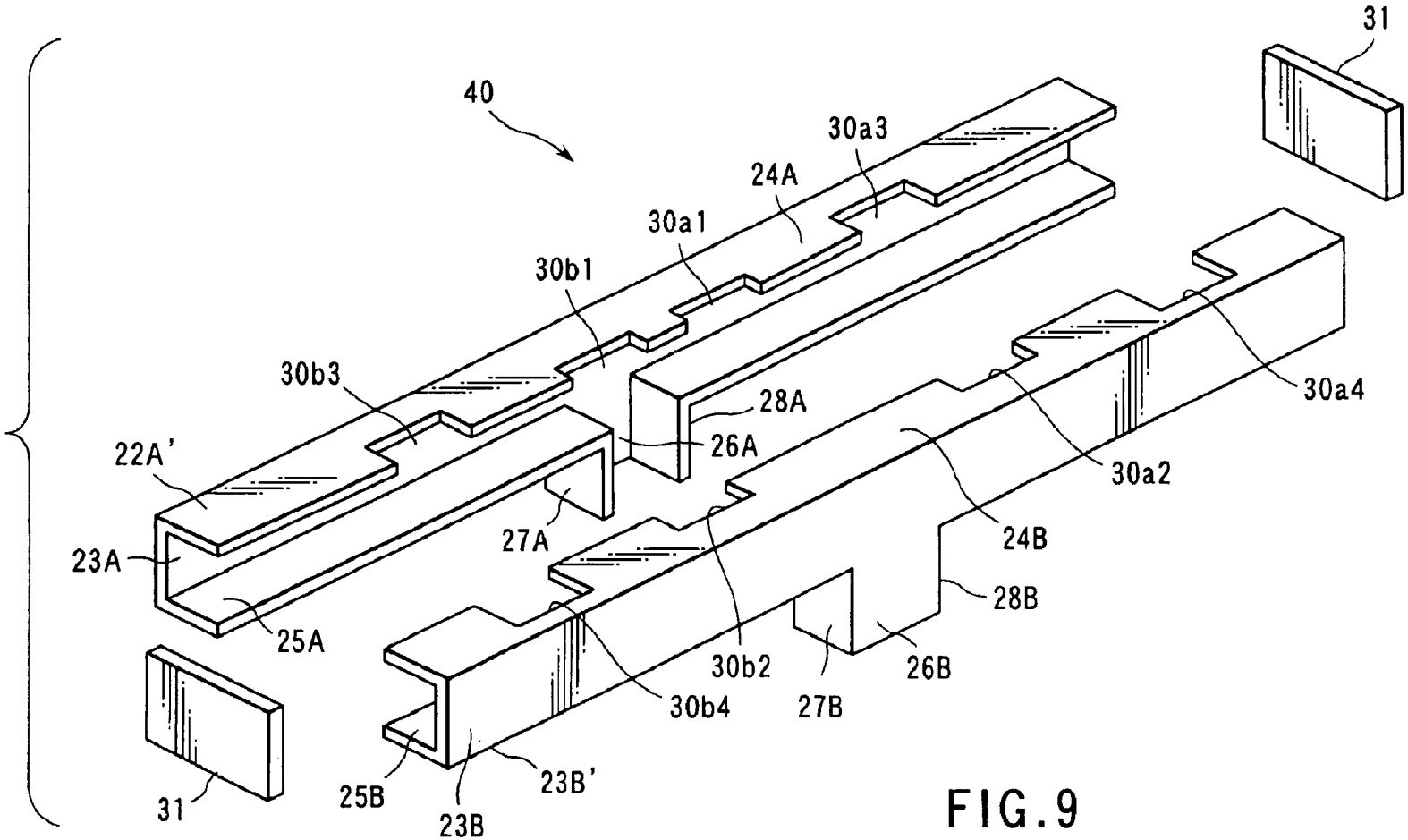
FIG. 9 is an exploded perspective view showing an exploded structure of the slotted waveguide radiator of the center feed type in FIG. 8.

As a slotted waveguide radiator 40 constituted in a center feed type shown in FIG. 8 and FIG. 9, however, such a constitution can be employed that electromagnetic wave is input from a feeding waveguide portion 42 provided at a center of a waveguide portion 41.

One channel-shaped member 22A' constituting the waveguide portion 41 of the slotted waveguide radiator 40 of the center feed type is provided with the base plate 23A forming one narrow side plate 41*a* of the above-described waveguide portion 41, the feed portion base plate 26A extending from an intermediate portion of the base plate 23A in a direction perpendicular to the base plate 23A and forming one narrow side plate of the feeding waveguide portion 42 in addition to the first half width plate 24A and the second half width plate 25A, a third half width plate 27A extending from one edge portion of the feed portion base plate 26A in a direction perpendicular to the feed portion base plate 26A and the second half width plate 25A by a distance equal to the width of the second half width plate 25A, and a fourth half width plate 28A extending from the other edge portion of the feed portion base plate 26A in a direction perpendicular to the feed portion base plate 26A and the second half width plate 25A by a distance equal to the width of the second half width plate 25A.

Similarly, the other channel-shaped member 22B' is provided with the base plate 23B forming the other narrow side plate 41*b* of the waveguide portion 41, the feed portion base plate 26B extending from an intermediate portion of the base plate 23B in a direction perpendicular to the base plate 23B and forming the other narrow side plate of the feeding waveguide portion 42 in addition to the first half width plate 24B and the second half width plate 25B, a third half width plate 27B extending from one edge portion of the feeding base plate 26B in a direction perpendicular to the feed portion base plate 26B and the second half width plate 25B by a distance equal to the width of the second half width plate 25B, and a fourth half width plate 28B extending from the other edge portion of the feed portion base plate 26B in a direction perpendicular to the feed portion base plate 26B and the second half width plate 25B by a distance equal to the width of the second half width plate 25B.

These two channel-shaped members 22A', 22B' are integrated in a state that edge faces of the first half width plates 24A, 24B, edge faces of the second half with plates 25A, 25B, edge faces of the third half width plates 27A, 27B, and edge faces of the fourth half width plates 28A, 28B are respectively joined to each other, and electromagnetic wave input into the feeding waveguide portion 42 is branched at an intermediate portion of the waveguide portion 41 to be propagated in directions of both end of the waveguide portion 41.

Then, a plurality of (four in this example), for example, rectangular slots $\mathbf{30}a_1$, $\mathbf{30}a_2$, . . . $\mathbf{30}a_4$ whose one sides are coincident with the central line Ca of the broad side plate 41*c* are provided at intervals of ½ (or an odder times) of the waveguide wavelength λg in a staggered manner in a range of the intermediate portion of the broad side plate 41*c* formed by the first half width plates 24A, 24B of the two channel-shaped members 22A', 22B' to one end thereof.

Further, a plurality of (four in this example), for example, rectangular slots $\mathbf{30}b_1$, $\mathbf{30}b_2$, . . . $\mathbf{30}b_4$ whose one sides are coincident with the central line Ca of the broad side plate 41*c* are provided at intervals of ½ (or an odder times) of the waveguide wavelength λg in a staggered manner in a range of the intermediate portion of the broad side plate 41*c* to the other end thereof.

Accordingly, electromagnetic waves directing from the intermediate portion of the waveguide portion 41 toward the one end of electromagnetic waves input from the feeding waveguide portion 42 are radiated from the slots $\mathbf{30}a_1$, $\mathbf{30}a_2$, . . . $\mathbf{30}a_4$ with almost the same phase and with almost the same amplitude.

Further, electromagnetic waves directing from the intermediate portion of the waveguide portion 41 toward the other end are radiated from the slots $\mathbf{30}b_1$, $\mathbf{30}b_2$, . . . $\mathbf{30}b_4$ with almost the same phase and with almost the same amplitude.

Here, by setting the positions of the slots $\mathbf{30}a_1$, $\mathbf{30}b_1$ properly, the phases and amplitudes of the electromagnetic waves radiated from the slots $\mathbf{30}a_1$, $\mathbf{30}a_2$, . . . $\mathbf{30}a_4$, and the slots $\mathbf{30}b_1$, $\mathbf{30}b_2$, . . . $\mathbf{30}b_4$ can be matched to one another.

(Second Embodiment)

Next, a slotted waveguide radiator used as a feed portion of a dielectric leaky-wave antenna will be explained as a second embodiment of the present invention.

Figure 10:
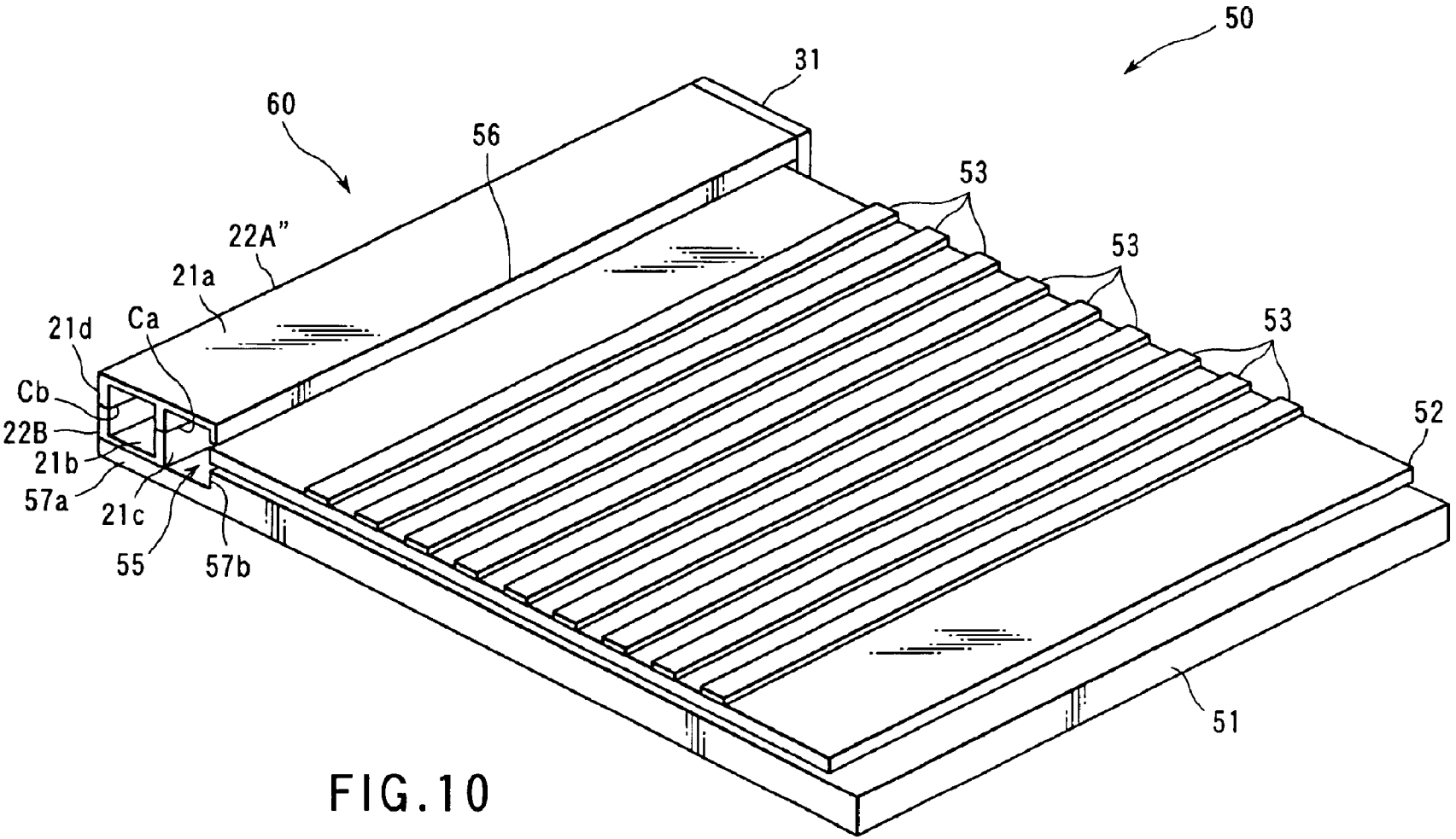
FIG. 10 is a perspective view showing an appearance constitution of a dielectric leaky-wave antenna where a slotted waveguide radiator according to a second embodiment of the present invention is applied to a feed portion.

FIG. 10 is a perspective view showing an appearance constitution of a dielectric leaky-wave antenna 50 where a slotted waveguide radiator according to a second embodiment of the present invention is applied to a feed portion.

Figure 11:
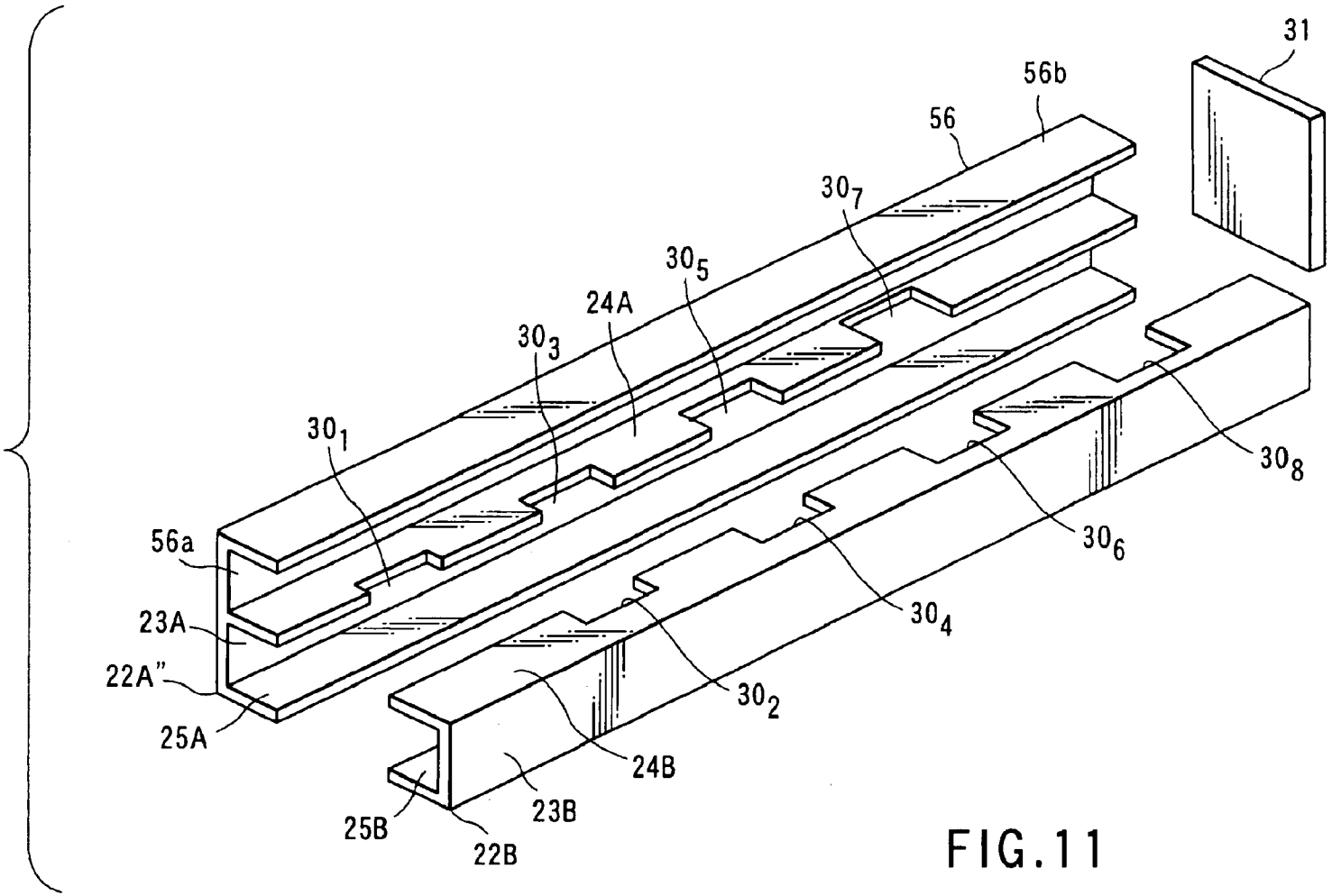
FIG. 11 is an exploded perspective view showing an exploded structure of the dielectric leaky-wave antenna in FIG. 10.

FIG. 11 is an exploded perspective view showing an exploded structure of the dielectric leaky-wave antenna 50 in FIG. 10.

That is, as shown in FIG. 10 and FIG. 11, in the dielectric leaky-wave antenna 50, a dielectric base plate 52 is disposed such that a clearance is formed between the dielectric base plate 52 and a metal ground plane 51 thereon via an unillustrated space.

Further, in the dielectric leaky-wave antenna 50, metal strips 53 which are parallel with one side of the dielectric base plate 52 are provided on at least one surface side of the dielectric base plate 52 at predetermined intervals.

Then, in the dielectric leaky-wave antenna 50, electromagnetic waves fed to one side of the dielectric base plate 52 with the same phase leak from a surface due to action of the metal strips 53.

For feeding an electromagnetic wave to one side of the dielectric base plate 52 of the dielectric leaky-wave antenna 50 with such a structure, a slotted waveguide radiator 60 formed to be generally similar to the slotted waveguide radiator 20 (which may be the slotted waveguide radiator 40) is disposed such that its slot surface is opposed to one side edge face of the dielectric base plate 52 in parallel therewith.

In this case, a matching portion 55 for inputting an electromagnetic wave radiated from the slotted waveguide radiator 60 to one side of the dielectric base plate 52 efficiently is provided between the slotted waveguide radiator 60 and the one side of the dielectric base plate 52.

The matching portion 55 is constituted with a matching plate 56 serving as a matching portion forming member, which is provided integrally with the slotted waveguide radiator 60, and a low stage portion 57*a* and a stepped wall 57*b* formed on one end side of the ground plane 51.

Here, as shown in FIG. 11, the matching plate 56 has a first strip-shaped plate portion 56*a* extending by a predetermined distance so as to be continuous to the base plate 23A of one channel-shaped member 22A" and a second strip-shaped plate portion 56*b* extending from an edge portion of the first plate portion 56*a* to the vicinity of a surface of the dielectric base plate 52 on one side thereof so as to be opposed to the first half width plate 24A in parallel therewith.

Incidentally, by tapering the interior of the matching portion 55 constituted with the matching plate 56, the low stage portion 57*a* of the ground plane 51 and the stepped wall 57*b*, the height of the space extending from the slot face (the broad side plate face) of the slotted waveguide radiator 60 to one side end face of the dielectric base plate 52 is narrowed in a stepped manner so that electromagnetic wave radiated from the slots 30 of the slotted waveguide radiator 60 can be concentrated and made incident on one side end face of the dielectric base plate 52 efficiently.

Even in case of the slotted waveguide radiator 60 having the matching plate 56 in this manner, as described above, two channel-shaped members 22A", 22B" can easily be manufactured according to injection molding using molds with a simple and inexpensive structure.

That is, this is because a mold drawing direction for two channel-shaped members 22A", 22B" and a mold drawing direction for the slot portions are identical and these direction is coincident with a mold drawing direction of a portion for the matching plate 56, and it can contribute to mass production of the dielectric leaky-wave antenna 50 as a whole.

Incidentally, such a constitution is employed that the above-described slotted waveguide radiator 60 is disposed on the low stage portion 57*a* positioned at one end side of the ground plane 51 constituting the dielectric leaky-wave antenna 50.

Figure 12:
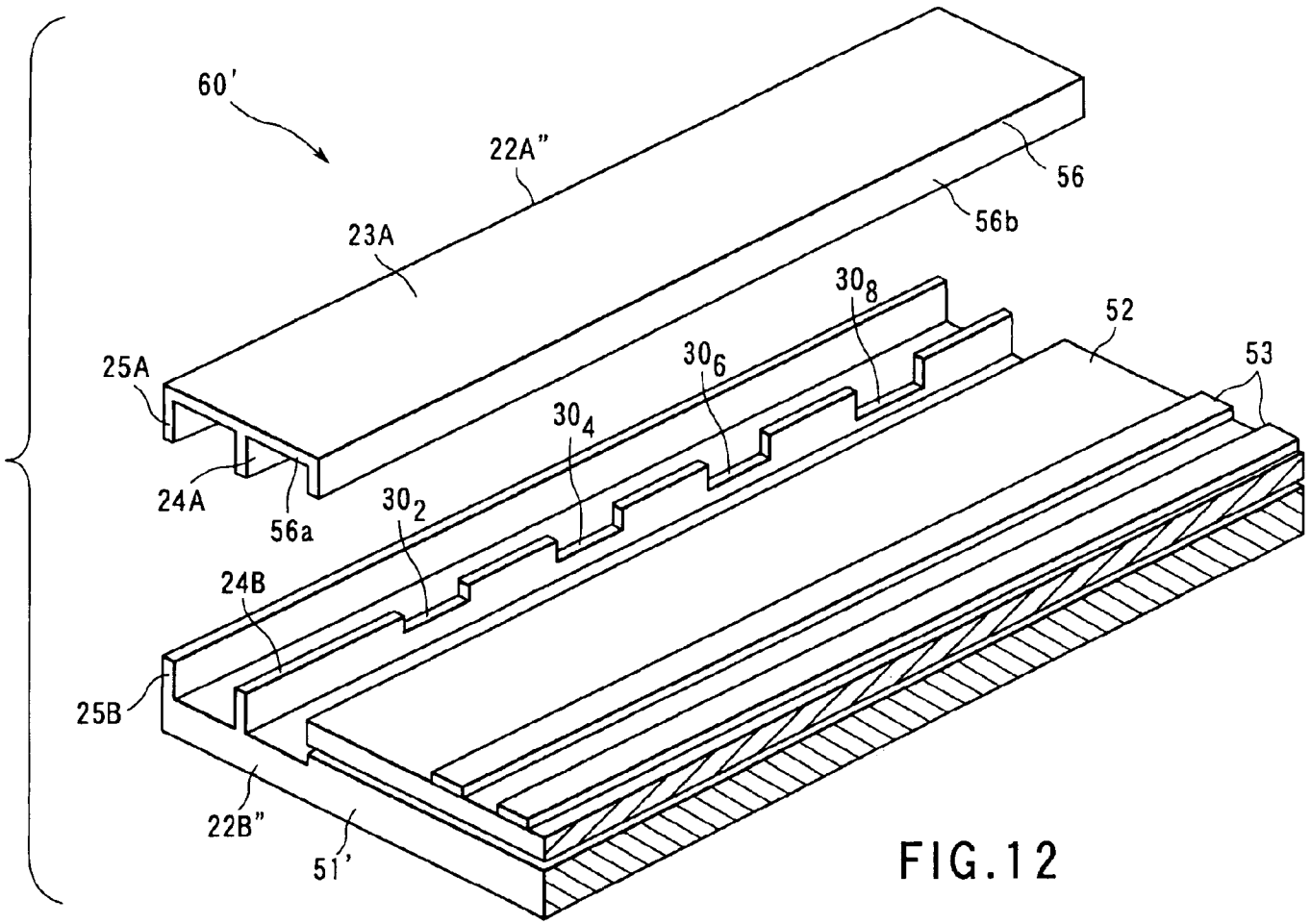
FIG. 12 is a perspective view showing a modification example where one of channel-shaped members of the slotted waveguide radiator is integrated with a ground plane of a dielectric leaky-wave antenna portion in the dielectric leaky-wave antenna in FIG. 10.

However, as one channel-shaped member 22B" of a slotted waveguide radiator 60' shown in FIG. 12, a slotted waveguide radiator may be formed integrally on a distal end side of the ground plane 51'.

By employing such a constitution, the number of parts for the dielectric leaky-wave antenna 50 can be reduced as a whole.

(Third Embodiment)

Next, a slotted waveguide radiator with a planar structure will be explained as a third embodiment of the present invention.

Figure 13:
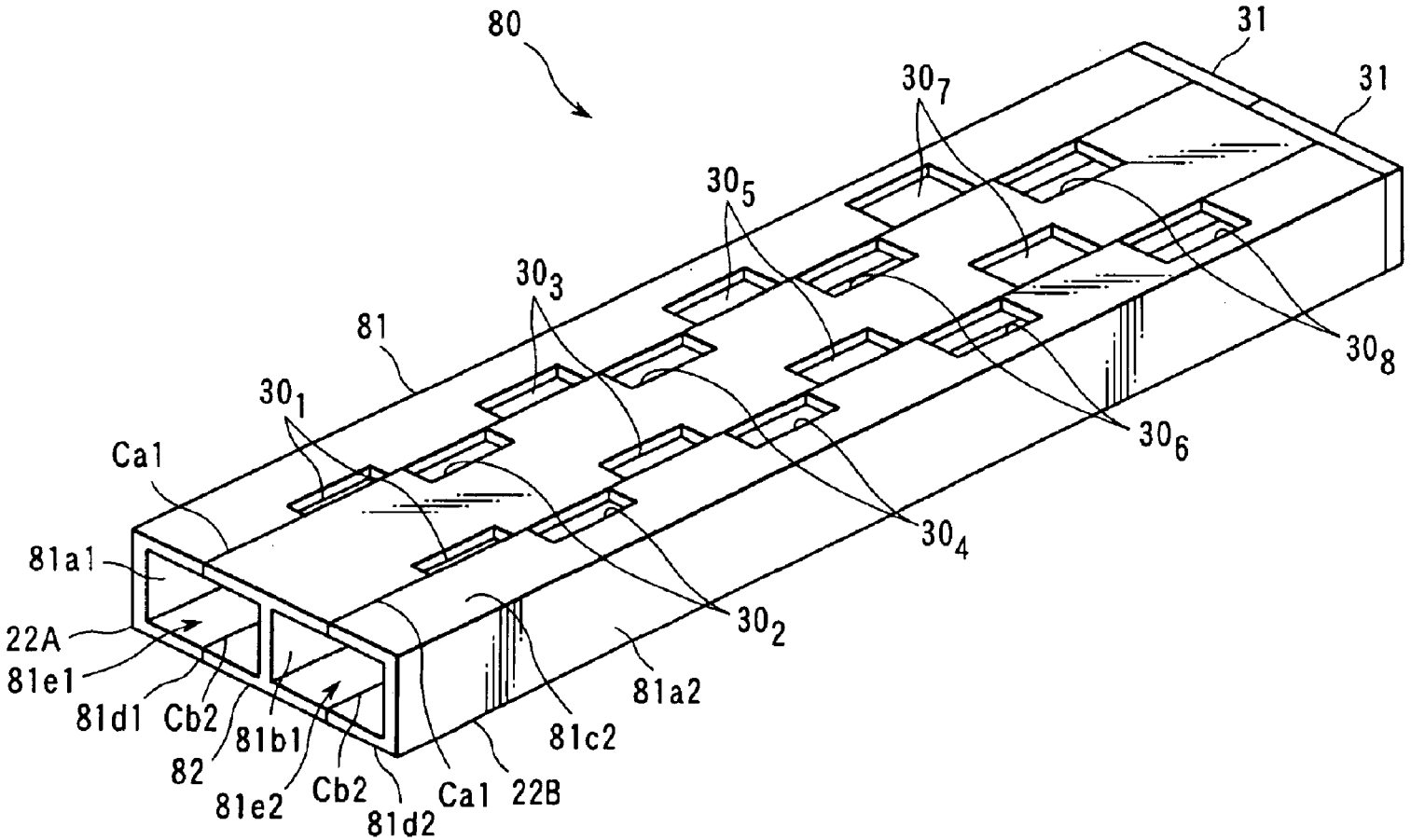
FIG. 13 is a perspective view showing an appearance constitution of a slotted waveguide radiator of a planar type as a third embodiment of the present invention.

FIG. 13 is a perspective view showing an appearance constitution of a slotted waveguide radiator 80 of a planar type as a third embodiment of the present invention.

Figure 14:
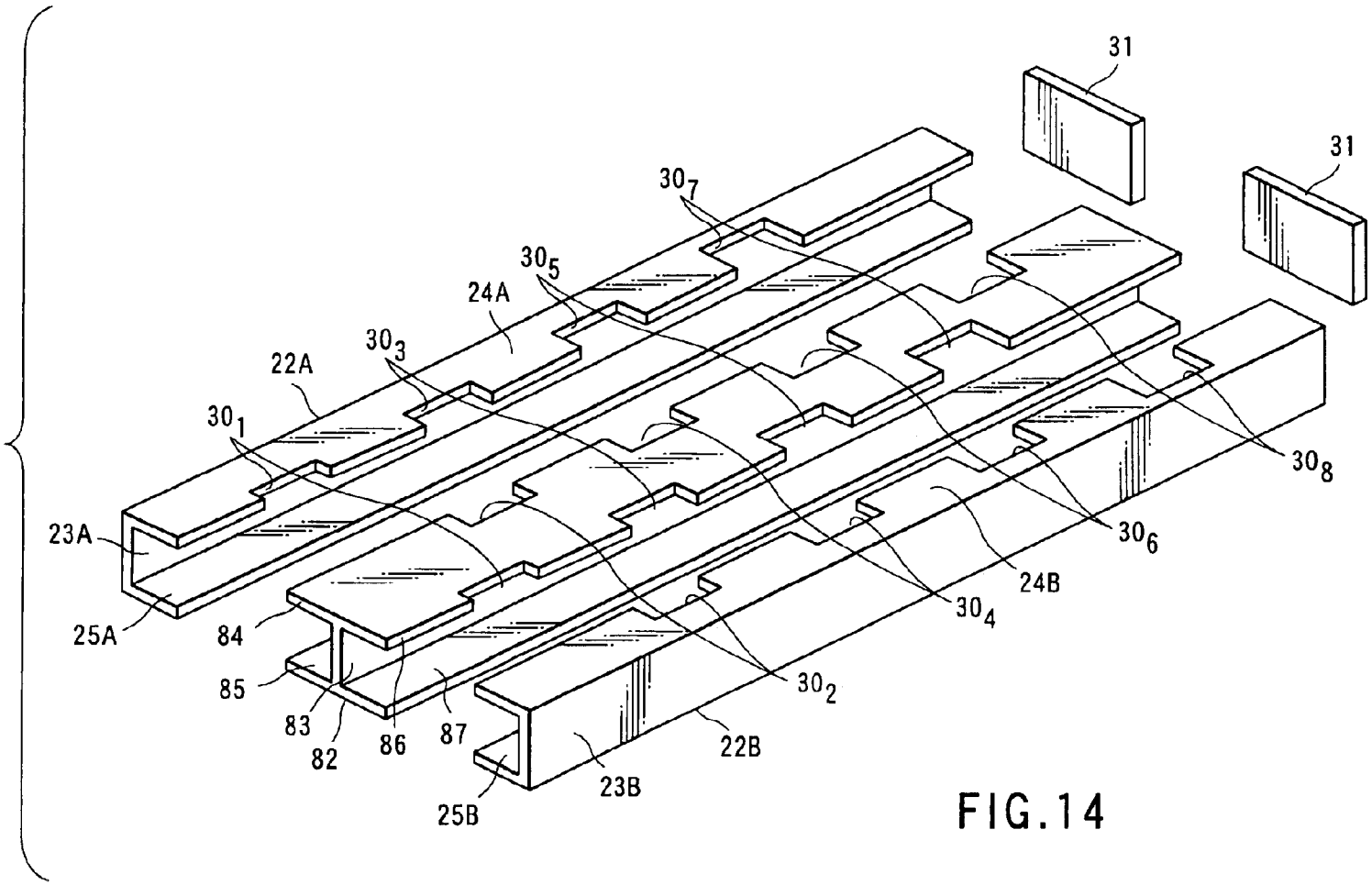
FIG. 14 is an exploded perspective view showing an exploded structure of the slotted waveguide radiator of the planar type in FIG. 13.

FIG. 14 is an exploded perspective view showing an exploded structure of the slotted waveguide radiator 80 of the planar type in FIG. 13.

That is, as shown in FIG. 13, FIG. 14, a waveguide portion 81 of the slotted waveguide radiator 80 is constituted with one H-shaped member 82, and the above-described two channel-shaped members 22A, 22B.

Here, the H-shaped member 82 is integrally formed so as to have a section with a lying H shape by a strip-shaped base plate 83 forming one narrow side plate of a waveguide portion 81, a first half width plate 84 extending from one edge portion (an upper edge) along in a lengthwise direction of the base plate 83 in a direction perpendicular to the base plate 83 by a distance equal to ½ of the width w of the broad side plate required for a waveguide formation, a second half width plate 85 extending from the other edge portion (an lower edge) along in the lengthwise direction of the base plate 83 in a direction opposed to the first half width plate 84 in parallel therewith by a distance equal to the above-described w/2, a third half width plate 86 extending from one edge portion (an upper edge) along the lengthwise direction of the base plate 83 in a direction perpendicular to the base plate 83 and opposite to the first half width plate 84 by a distance equal to the above-described w/2, and a fourth half width plate 87 extending from the other edge portion (an lower edge) along in the lengthwise direction of the base plate 83 in a direction opposite to the third half width plate 86 in parallel therewith by a distance equal to the above-described w/2.

The waveguide portion 81 having the H-shaped member 82 thus constituted is integrated and constituted in a state that joining of end faces of the first half width plate 84 of the H-shaped member 82 and the first half width plate 24A of one channel-shaped member 22A and joining of end faces of the second half width plate 85 and the second half width plate 25A of the one channel-shaped member 22A have been conducted and joining of end faces of the third half width plate 86 of the H-shaped member 82 and the first half width plate 24B of the other channel-shaped member 22B and joining of end faces of the fourth half width plate 87 and the second half width plate 25B of the other channel-shaped member 22B have been conducted.

Thus, in the waveguide portion 81 comprising one H-shaped member 82 and two channel-shaped members 22A, 22B, a first waveguide 81$e_1$ with a rectangular section (rectangle) surrounded by a narrow side plate 81$a_1$ formed by the base plate 23A of one channel-shaped member 22A, a narrow side plate 81$b_1$ formed by the base plate 83 of the H-shaped member 82, a broad side plate 81$c_1$ formed by the first half width plate 24A of one channel-shaped member 22A and the first half width plate 84 of the H-shaped member 82 joined thereto, and a broad side plate 81$d_1$ formed the second half width plate 25A of one channel-shaped member 22A and the second half width plate 85 of the H-shaped member 82 joined thereto is formed.

Further, a second waveguide 81$e_2$ with a rectangular section (rectangle) surrounded by a narrow side plate 81$b_1$ formed by the base plate 83 of the H-shaped member 82, a narrow side plate 81$a_2$ formed by the base plate 23B of the other channels-shaped member 22B, a broad side plate 81$c_2$ formed by the third half width plate 86 of the H-shaped member 82 and the first half width plate 24B joined thereto, and a broad side plate 81$d_2$ formed by the fourth half width plate 87 of the H-shaped member 82 and the second half width plate 25B of the other channel-shaped member 22B joined thereto is formed.

Then, slots 30$_2$, 30$_4$, . . . 30$_8$ are provided in the first half width plate 84 of the H-shaped member 82 in the same manner as the first half width plate 24B of the other channel-shaped member 22B.

Further, slots 30$_1$, 30$_3$, . . . 30$_7$ are provided in the third half width plate 86 of the H-shaped member 82 in the same manner as the first half width plate 24A of the one channel-shaped member 22A.

Accordingly, in this slotted waveguide radiator 80, when electromagnetic waves with the same amplitude are input with the same phase from one end sides of the waveguides 81$e_1$, 81$e_2$, electromagnetic waves with almost the same phase and with almost the same amplitude are radiated from the slots 30$_1$, 30$_2$, . . . 30$_8$ which are respectively provided in the broad side plates 81$c_1$, 81$c_2$ externally.

Further, even the slotted waveguide radiator 80 is constituted by a plurality of members 82, 22A, 22B joined at central lines $Ca_1$, $Ca_2$, $Cb_1$, $Cb_2$ of the broad side plates 81$c_1$, 81$c_2$, 81$d_1$, 81$d_2$.

Furthermore, the slotted waveguide radiator 80 has a structure that, for example, rectangular slots 30$_1$, 30$_2$, . . . 30$_8$ whose one sides are coincident with the central lines $Ca_1$, $Ca_2$ of the broad side plates 81$c_1$, 81$c_2$.

Accordingly, in the slotted waveguide radiator 80, the H-shaped member 82 can also be manufactured at a low cost using simple molds including the slot portions like the above-described two channel-shaped members 22A, 22B.

Incidentally, the waveguide portion 81 of the above-described slotted waveguide radiator 80 is constituted by one H-shaped member 82 and two channel-shaped members 22A, 22B.

However, such a slotted waveguide radiator may be constituted with a plurality of "m" H-shaped members 82$_1$, 82$_2$, . . . 82$_m$ and two channel-shaped members 22A, 22B.

Figure 15:
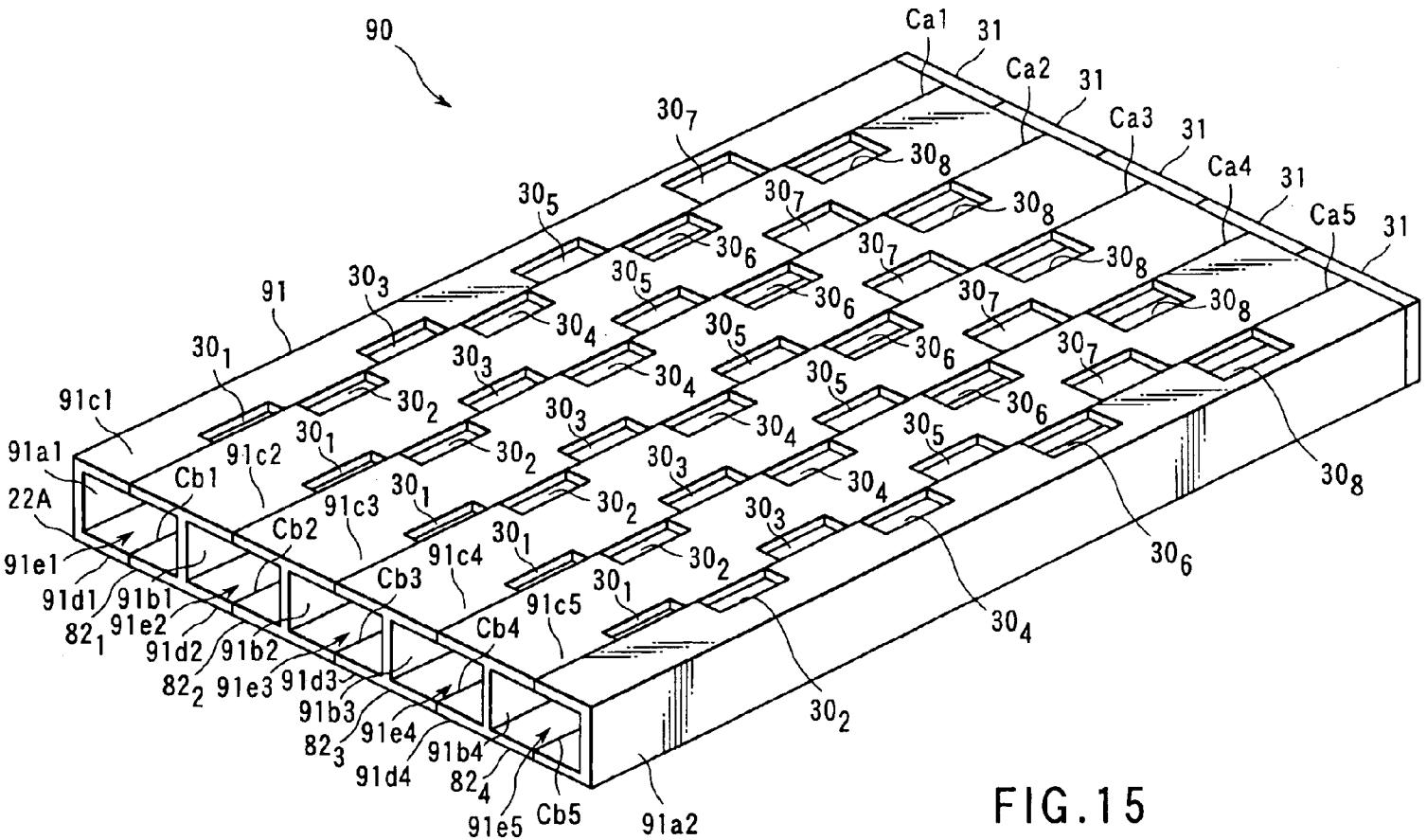
FIG. 15 is a perspective view showing a modification example where a plurality of H-shaped members are used in the slotted waveguide radiator of the planar type in FIG. 13.
Figure 16:
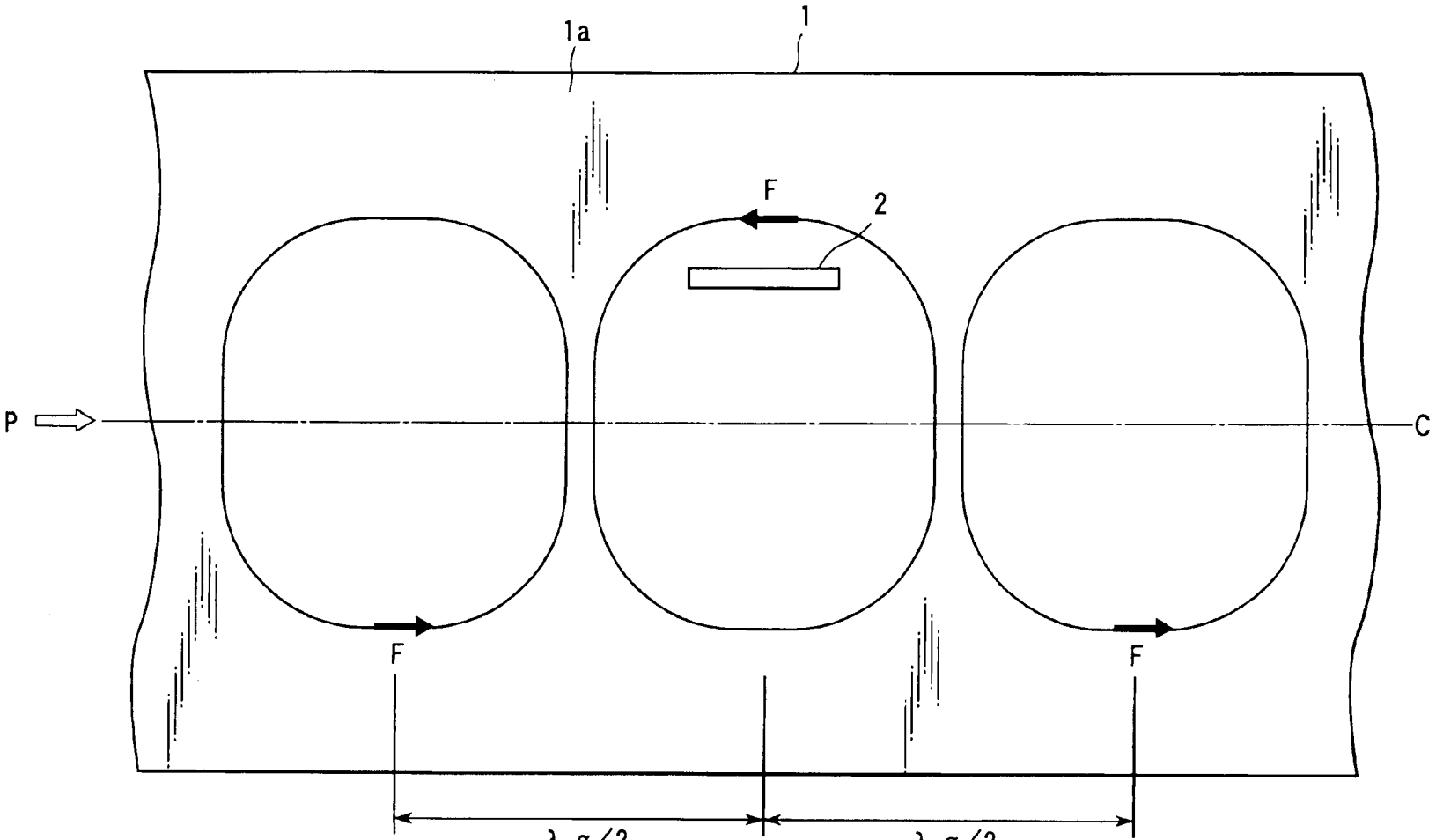
FIG. 16 (PRIOR ART)
FIG. 16 is a diagram for explaining a principle of a slotted waveguide radiator known conventionally.
Figure 17:
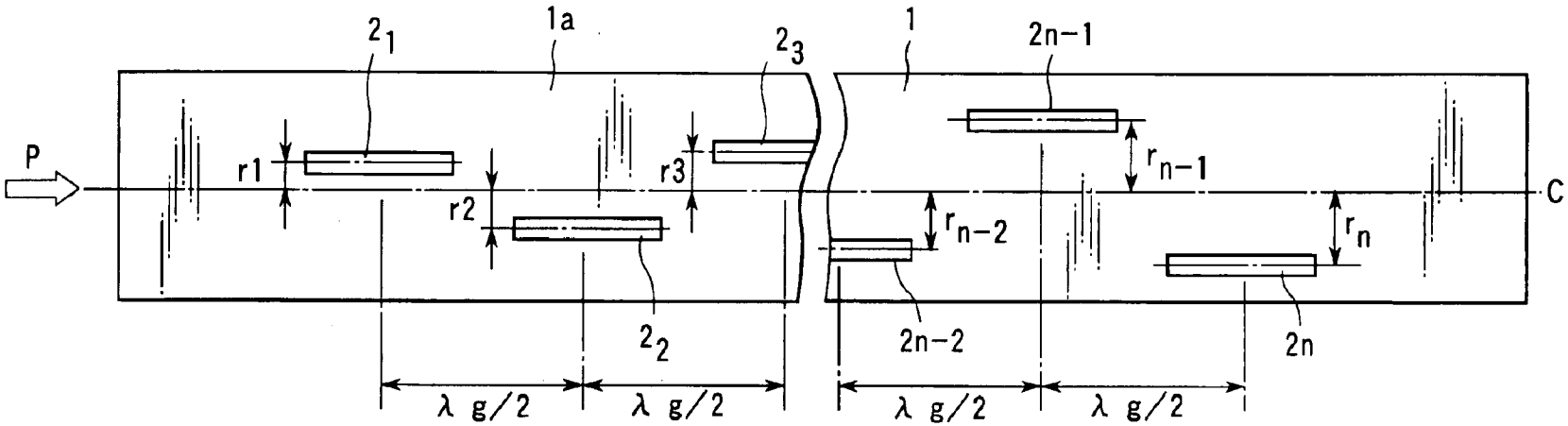
FIG. 17 (PRIOR ART)
FIG. 17 is a plan view of a conventional slotted waveguide radiator with a single waveguide array structure.
Figure 18:
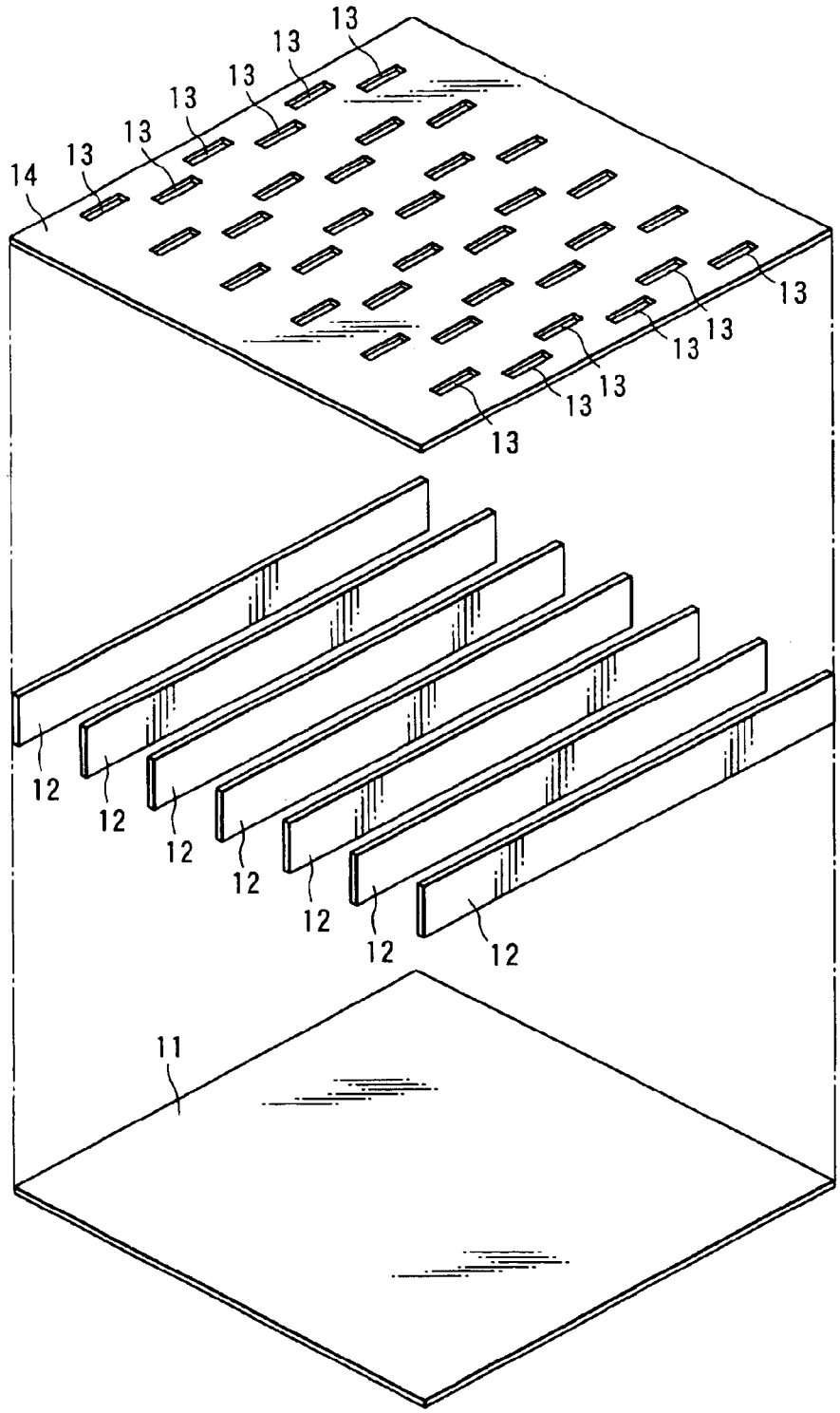
FIG.18 (PRIOR ART)
FIG. 18 is an exploded perspective view showing an exploded structure of a conventional slotted waveguide radiator of a planar type.

FIG. 15 shows an example that, as a slotted waveguide radiator 90, a waveguide portion 91 is constituted by m=4, i.e., four H-shaped members 82$_1$, 82$_2$, . . . 82$_4$ and two channel-shaped members 22A, 22B.

In this example, four H-shaped members 82$_1$, 82$_2$, . . . , 82$_4$ are provided adjacent to one another such that joining of end faces of the j-th (j=1, 2, 3) H-shaped member 82$_j$ and the (j+1)-th H-shaped member 82$_{j+1}$ to each other, and joining of end faces of the four half width plate 87 of the j-th H-shaped member 82$_j$ and the second half width plate 85 of the (j+1)-th H-shaped member 82$_{j+1}$ to each other are conducted.

Then, joining of end faces of the first half width plate 84 of the H-shaped member 82$_1$ on one end and the first half width plate 24A of one channel-shaped member 22A and joining of end faces of the second half width plate 85 of the H-shaped member $\mathbf{82}_1$ and the second half width plate 25A of one channel-shaped member 22A are conducted.

Further, the waveguide portion 91 is constituted by conducting integration in a state that joining of end faces of the third half width plate 86 of the H-shaped member 82 on the other end and the first half width plate 24B of the other U-shaped member 22B and joining of end faces of the fourth half width plate 87 of the H-shaped member $\mathbf{82}_4$ and the second half width plate 25B of the other channel-shaped plate 22B have been conducted.

In the waveguide portion 91 of the slotted waveguide radiator 90 thus constituted, a waveguide $\mathbf{91}e_1$ with a rectangular section (a rectangle) surrounded by a narrow side plate $\mathbf{91}a_1$ comprising the base plate 23A of one channel-shaped member 22A, a narrow side plate $\mathbf{91}b_1$ comprising the base plate 83 of the H-shaped member $\mathbf{82}_1$, a broad side plate $\mathbf{91}c_1$ comprising a first half width plate 24A of one channel-shaped member 22A and the first half width plate 84 of the H-shaped member $\mathbf{82}_1$ joined thereto, and a broad side plate $\mathbf{91}d_1$ comprising a second half width plate 25A of the one channel-shaped member 22A and the second half plate 85 of the H-shaped member $\mathbf{82}_1$ joined thereto is formed.

Further, waveguides $\mathbf{91}e_{j+1}$ with a rectangular section (a rectangle) surrounded by a narrow side plate $\mathbf{91}b_j$ comprising the base plate 83 of the H-shaped member $\mathbf{82}_j$, a narrow side plate $\mathbf{91}b_{j+1}$ comprising the base plate 83 of a H-shaped member $\mathbf{82}_{j+1}$, a broad side plate $\mathbf{91}c_{j+1}$ comprising the third half width plate 86 of the H-shaped member $\mathbf{82}_j$ and a first half width plate 84 of the H-shaped member $\mathbf{82}_{j+1}$ joined thereto, and a broad side plate $\mathbf{91}d_{j+1}$ comprising a fourth width plate 87 of the H-shaped member $\mathbf{82}_j$ and a second half width plate 85 of the H-shaped member $\mathbf{82}_{j+1}$ joined thereto are formed respectively regarding respective j=1 to m−1 (m=4).

Furthermore, a waveguide $\mathbf{91}e_5$ with a rectangular section (a rectangle) surrounded by a narrow side plate $\mathbf{91}b_4$ comprising a base plate 83 of a H-shaped member $\mathbf{82}_4$, a narrow side plate $\mathbf{91}a_2$ comprising a base plate 23B of the other channel-shaped member 22B, a broad side plate $\mathbf{91}c_5$ comprising a third half width plate 86 of the H-shaped member $\mathbf{82}_4$ and a first half width plate 24B of the other channel-shaped member 22B joined thereto, and a broad side plate $\mathbf{91}d_5$ comprising a fourth half width plate 87 of the H-shaped member $\mathbf{82}_4$ and a second half plate 25B of the other channel-shaped member 22B joined thereto is formed.

Then, as described above, for example, rectangle-shaped slots $\mathbf{30}_1$, $\mathbf{30}_2$, . . . $\mathbf{30}_8$ are provided in the first half width plates 84 and the third half width plate 86 of each H-shaped member 82, and the first half width plates 24A, 24B of the two channel-shaped members 22A, 22B.

Accordingly, when electromagnetic waves with the same amplitude are input with the same phase from one end sides of these 5 (=m+1) waveguides $\mathbf{91}e_1$, $\mathbf{91}e_2$, $\mathbf{91}e_5$, electromagnetic waves with almost the same phase and with almost the same amplitude are radiated from the slots $\mathbf{30}_1$, $\mathbf{30}_2$, . . . $\mathbf{30}_8$ which are respectively provided in the respective broad side plates 91c.

Further, even the slotted waveguide radiator 90 is also constituted with a plurality of members $\mathbf{82}_1$, $\mathbf{82}_2$, . . . $\mathbf{82}_4$, 22A, 22B obtained by division at central lines $Ca_1$, $Ca_2$, . . . $Ca_5$, $Cb_1$, $Cb_2$, . . . $Cb_5$ of the broad side plates $\mathbf{81}c_1$, $\mathbf{81}c_2$, . . . $\mathbf{81}c_5$, $\mathbf{81}d_1$, $\mathbf{81}d_2$, . . . $\mathbf{81}d_5$ like the above-described slotted waveguide radiator 80.

Further, the slotted waveguide radiator 90 has a structure that rectangular slots $\mathbf{30}_1$, $\mathbf{30}_2$, . . . $\mathbf{30}_8$ whose one sides are coincident with the central lines $Ca_1$, $Ca_2$, . . . $Ca_5$ of the broad side plates $\mathbf{81}c_1$, $\mathbf{81}c_2$, . . . $\mathbf{81}c_5$ have been provided.

Accordingly, respective members of the slotted waveguide radiator 90 including the slot portions can be manufactured at an expensive cost using simple molds.

As explained above, the slotted waveguide radiator of the present invention is provided such that the waveguide portion is constituted with a plurality of waveguide members joined at the central line of a pair of broad side plates, and one side of the slot is coincident with the central line of one broad side plate.

For this reason, in the slotted waveguide radiator of the present invention, members including a slot can be manufactured by injection molding using molds with a simple structure, and a mass production is facilitated, because joining work can be conducted easily.

Therefore, according to the present invention, the problem in the prior art as described above is solved and a slotted waveguide radiator can be provided which can be manufactured at a low cost using simple molds and which can facilitate joining work and can prevent grating lob from occurring.

Further, according to the present invention, the problem in the prior art as described above is solved and a slotted waveguide radiator can be provided which can be manufactured at a low cost using simple molds and which can facilitate joining work and can provide a matching plate integrally therewith.

What is claimed is:

1. A slotted waveguide radiator Comprising:

a waveguide portion having a waveguide with a rectangular section surrounded by a pair of narrow aide plates opposed to each other, and a pair of broad side plates extending along the lengthwise direction of the pair of narrow side plates; and a radiation portion which is provided on one broad side plate of the pair of broad side plates of the waveguide portion and which has a plurality of slots for radiating an electromagnetic wave input into the waveguide portion externally from the one broad side plate, wherein:

the waveguide portion includes a first waveguide member and a second waveguide member, and the first waveguide member and the second waveguide member are joined at edge portions, in longitudinal directions thereof, matched with central lines of the pair of broad side plates;

said plurality of slots of the radiation portion include a first group of slots and a second group of slots which are respectively defined in the first waveguide member and the second waveguide member at predetermined intervals in a staggered manner; and the first group of slots and the second group of slots are provided such that one side of each slot of the respective groups is coincident with the central lines of the pair of broad side plates.

2. A slotted waveguide radiator according to claim 1, wherein the predetermined interval is set to an interval of ½ of a waveguide wavelength λg of an electromagnetic wave to be radiated by the slotted waveguide radiator in the waveguide portion.

3. The slotted waveguide radiator according to claim 1, wherein the first group of slots and the second group of slots are set such that the widths of the respective slots are made larger from a position near to an input end of an electromagnetic wave to be radiated by the slotted waveguide radiator toward a position farther therefrom.

4. The slotted waveguide radiator according to claim 3, wherein the input end of the electromagnetic wave is of an edge feed type formed at one end, in a longitudinal direction, of the waveguide portion.

5. The slotted waveguide radiator according to claim 3, wherein the input end of the electromagnetic wave is of a center feed type formed at a center, in a longitudinal direction, of the waveguide portion.

6. The slotted waveguide radiator according to claim 3, wherein a plurality of reflection suppressors are provided on an inner wall of the waveguide portion at predetermined intervals in a longitudinal direction of the waveguide portion.

7. The slotted waveguide radiator according to claim 6, wherein said plurality of reflection suppressors are ribs.

8. The slotted waveguide radiator according to claim 6, wherein said plurality of reflection suppressors are grooves.

9. The slotted waveguide radiator according to claim 3, wherein at least one end where the input end of the electromagnetic wave in the longitudinal direction of the waveguide portion is not formed is terminated at a terminating plate.

10. The slotted waveguide radiator according to claim 1, wherein a matching portion forming member for feeding an electromagnetic wave radiated from the slotted waveguide radiator to a dielectric leaky-wave antenna efficiently is provided integrally with the waveguide portion.

11. The slotted waveguide radiator according to claim 1, wherein the waveguide portion includes a plurality of waveguide members, and said plurality of waveguide members include two channel-shaped members formed integrally in a sectional channel shape by a strip-shaped base plate forming the narrow side plate, a first half width plate extending from one edge portion of the base plate along in a lengthwise direction thereof in a direction perpendicular to the base plate by a distance equal to ½ of the broad side plate, and a second half width plate extending from the other edge portion of the base plate along the lengthwise direction thereof in a direction opposed to the first half width plate in parallel thereto by a distance equal to ½ of the broad side plate.

12. The slotted waveguide radiator according to claim 11, wherein the two channel-shaped members are integrated in a state that joining of end faces of the first half width plates of the two channel-shaped members and joining of end faces of the second half width plates thereof have been conducted.

13. The slotted waveguide radiator according to claim 11, wherein said plurality of waveguide members include an H-shaped member formed integrally in a sectional H shape by a strip-shaped base plate forming the narrow side plate, a first half width plate extending from one edge portion of the base plate along in a lengthwise direction thereof in a direction perpendicular to the base plate by a distance equal to ½ of the broad side plate, a second half width plate extending from the other edge portion of the base plate along the lengthwise direction thereof in a direction opposed to the first half width plate in parallel thereto by a distance equal to ½ of the broad side plate, a third half width plate extending from one edge portion of the base plate along the longitudinal direction thereof in a direction perpendicular to the base plate and opposed to the first half width plate by a distance equal to ½ of the broad side plate, and a fourth half width plate extending from the other edge portion of the base plate along the longitudinal direction thereof in a direction opposed to the third half width plate in parallel thereto by a distance equal to ½ of the broad side plate.

14. The slotted waveguide radiator according to claim 13, wherein the waveguide portion comprises the H-shaped member and the two channel-shaped members which are integrated in a state that joining of end faces of the H-shaped member and the first half width plate of one of the two channel-shaped members to each other and joining of end faces of the second half width plates to each other have been conducted, and joining of end faces of the third half width plate of the H-shaped member and the first half width plate of the other of the two channel-shaped members to each other and joining of end faces of the fourth half width plate of the H-shaped member and the second half width plate of the other of the two channel-shaped members to each other have been conducted.

15. The slotted waveguide radiator according to claim 13, wherein a third group of slots and a fourth group of slot are provided in the respective end faces of the H-shaped member in a staggered manner to the first group of slots and the second group of slots.

16. The slotted waveguide radiator according to claim 13, wherein the waveguide portion has the plurality of H-shaped members mounted between the two channel-shaped members, and is configured in an integral manner by providing the respective H-shaped members adjacent to one another such that joining of end faces of the first half width plate and the third half width plate to each other and joining of the second half width plate and the fourth half width plate to each other have been conducted, joining of end faces of the H-shaped member on one end of the waveguide portion and the first half width plate of one of the two channel-shaped members and joining of end places of the H-shaped member on the one end and the second half width plate have been conducted, and joining of end faces of the third half width plate of the H-shaped member on the other end of the waveguide portion and the first half width plate of the other of the two channel-shaped members and joining of end faces of the fourth half width plate of the H-shaped member on the other end thereof and the second half width plate of the other of the two channel-shaped members have been conducted.

17. The slotted waveguide radiator according to claim 16, wherein two groups of slots are respectively provided in the respective end faces of said plurality of H-shaped members in a staggered manner to the first group of slots and the second group of slots.

18. The slotted waveguide radiator according to claim 13, wherein the H-shaped member is formed integrally by injection molding using molds in a sectional H shape by a strip-shaped base plate forming the narrow side plate, a first half width plate extending from one edge portion of the base plate along in a lengthwise direction thereof in a direction perpendicular to the base plate by a distance equal to ½ of the broad side plate, a second half width plate extending from the other edge portion of the base plate along the lengthwise direction thereof in a direction opposed to the first half width plate in parallel thereto by a distance equal to ½ of the broad side plate, a third half width plate extending from the edge portion of the base plate along the longitudinal direction thereof in a direction perpendicular to the base plate and opposed to the first half width plate by a distance equal to ½ of the broad side plate, and a fourth half width plate extending from the other edge portion of the base plate along the longitudinal direction thereof in a direction opposed to the third half width plate in parallel thereto by a distance equal to ½ of the broad side plate.

19. The slotted waveguide radiator according to claim 16 wherein a matching portion forming member for feeding an electromagnetic wave radiated from the slotted waveguide radiator to a dielectric leaky-wave antenna efficiently is integrally provided on the waveguide portion.

20. The slotted waveguide radiator according to claim 11, wherein the two channel-shaped members are each formed by injection molding using molds in a sectional channel shape where the pair of broad side plates including the one broad side plate where the first group of slots and the second group of slots are defined and the pair of narrow side plates have been divided into two pieces at central lines of the pair of broad side plates.

* * * * *